US010154727B2

(12) United States Patent
Fleischer

(10) Patent No.: US 10,154,727 B2
(45) Date of Patent: Dec. 18, 2018

(54) LIGHT PACK FOR A PAINTBRUSH

(76) Inventor: John Fleischer, Airdrie (CA)

( * ) Notice: Subject to any disclaimer, the term of this patent is extended or adjusted under 35 U.S.C. 154(b) by 252 days.

(21) Appl. No.: 13/485,626

(22) Filed: May 31, 2012

(65) Prior Publication Data

US 2012/0324663 A1 Dec. 27, 2012

Related U.S. Application Data

(63) Continuation-in-part of application No. 13/508,710, filed as application No. PCT/CA2010/001788 on Nov. 9, 2010, now Pat. No. 9,414,669.

(60) Provisional application No. 61/259,263, filed on Nov. 9, 2009.

(51) Int. Cl.

| | |
|---|---|
| ***A46B 7/04*** | (2006.01) |
| ***A46B 15/00*** | (2006.01) |
| ***A46B 17/02*** | (2006.01) |

(52) U.S. Cl.

CPC ..... *A46B 7/042* (2013.01); *A46B 15/0036* (2013.01); *A46B 17/02* (2013.01); *A46B 2200/202* (2013.01)

(58) Field of Classification Search

CPC ..... A46B 7/042; A46B 15/0036; A46B 17/02; A46B 2200/202

USPC ..... 362/109, 119, 120; 15/105

See application file for complete search history.

(56) References Cited

U.S. PATENT DOCUMENTS

| | | | | |
|---|---|---|---|---|
| 2,122,215 | A * | 6/1938 | Saelen | A01K 85/01 362/203 |
| 4,494,268 | A * | 1/1985 | Chu | 15/176.1 |
| 4,916,773 | A * | 4/1990 | McCoy | 15/205.2 |
| 2007/0240275 | A1* | 10/2007 | Willenbring | 15/324 |

* cited by examiner

*Primary Examiner* — Anh T Mai

*Assistant Examiner* — Jessica M Apenteng

(74) *Attorney, Agent, or Firm* — Tai W. Nahm; Miller Thomson LLP

(57) ABSTRACT

There is disclosed a light pack for a paintbrush having a detachable bristle portion, characterized by one or more lights disposed adjacent to at least one side of the handle and aimed to emit light at an angle toward the edge when the bristles are bent when n object is painted. In an embodiment, the paintbrush comprises a handle having a gripping end and a bristle end, and a plurality of bristles having an edge to contact an object being painted, characterized in that the light pack is adapted to be positioned relative to the handle such that one or more lights in the light pack are aimed to emit light at an angle toward the edge when the bristles are bent when an object is painted.

17 Claims, 78 Drawing Sheets

LIGHT PACK FOR A PAINTBRUSH

CROSS-REFERENCE TO RELATED APPLICATIONS

This application is a continuation-in-part of patent application Ser. No. 13/508,710 filed May 8, 2012, which claims benefit of International Application No. PCT/CA2010/001788, filed Nov. 9, 2010, which claims benefit of U.S. Patent Application No. 61/259,263, filed Nov. 9, 2009, all of which are incorporated herein by reference.

FIELD

The present disclosure relates in general to the field of a paintbrush and more particularly to a paintbrush equipped with a light pack.

BACKGROUND

A painter cutting in to any object such as a window or door casing or any trim molding which is a different colour than the paint he is using may have trouble seeing the exact transition from one surface to the other. This is especially the case in new construction of homes and light commercial projects where it is standard to use portable work lights with as much as 500 watt bulbs moved from room to room by the painter as needed. These high-powered lights cause a lot of dark shadows. Shadows may be caused by the painter's hand or trim mould, which may be between the high-powered light and the crucial work area. This set-up causes frustration, inconvenience, and lost time by the painter in the numerous times it takes to reposition the light to avoid shadows for each trim area to be cut to. This is especially true over the winter months when there is a very limited amount of daylight in each day, and work lights are required as the only source of light.

U.S. Pat. No. 7,127,770, issued Oct. 31, 2006, discloses an LED brush. The brush in this patent is a thin, pencil-styled brush with an illuminated transparent handle, directing light from the end of the handle and the sides of the handle. Batteries are stored within the housing, and power a seven-color LED module made of three light emitting diodes. The transparent handle illuminated by a seven-colour LED module has a module controller. The brush may have various brush heads selected from a group of blush brush, finishing trim, eye shadow, eye comb, mini brush, concealer brush, foundation brush, powder brush, eye shadow brush, small slanted brush, lip brush, and eyebrow or eyelash brush.

U.S. Patent Publication No. 2006/0215391, filed Sep. 28, 2006, is an addition to patent application Ser. No. 11/088,294 filed Mar. 24, 2005, titled "Lighted Cleaning Implement." This prior art relates to a wide variety of cleaning equipment. The patent application discloses an invention generally related to cleaning implements, such as brooms, mops, whisk brooms, coating applicators, dusters, and brushes and more particularly, relates to illuminating features incorporated in hand-held detail brushes and other implements.

U.S. Pat. No. 5,218,733, issued Jun. 15, 1993, discloses a style of paintbrush assembled from five main parts including: a main handle with a shoulder and a rabbited end in which the brush panel(s) are fit; bristle panels consisting of bristles bound by a back in the form of a flat body; a clamping plate has a hole designed for the head of a thumbscrew to go through; a typical washer; and a thumbscrew. Once the handle bristles and the clamping plate are in place the washer and thumbscrew are installed, which tightens the group together as one.

U.S. Patent Publication No. 2002/0148058, filed Oct. 17, 2002, describes a 2-part paintbrush comprised of a handle subassembly and a brush subassembly. The handle sides of handle subassemblies are molded of plastic as opposite sides and sonically welded or glued together. All the handle types described have a hollow cavity, with an open forward end (referred to as a tool connecter), and two openings referred to as windows. These are located directly across from each other, at the location of where the handle widens. The brush subassembly consists of these major parts, a) a bristle pack with a pack base; b) a brush ferrule (of various styles); and c) a handle connecter or linking assembly.

U.S. Pat. No. 5,359,749, issued Nov. 1, 1994, relates to an improvement for a paintbrush described in U.S. Pat. No. 4,494,269, issued Jan. 22, 1985, and involves using of a headless pin for mounting the bristle portion onto the handle of the brush. This patent discloses 3-part paintbrush. One part is a handle made of plastic or light metal, with one end being in the form of an open tubular body of a generally rectangular shape. The second part is a bristle portion, comprised of a retaining member, in the form of an open tubular body, generally rectangular shaped, of which the bristles or sponge are fixed by adhesive. The final part is a pin molded from plastic or light metal held by apertures formed on the opposite walls of the connecting chamber due to tight tolerance.

There is a need for a paintbrush that does not require the constant moving and reposition of a work light. The work light may simply remain in the center of the room and the lighted paintbrush of the present invention gives all other light exactly where it is required by the person cutting into areas such as door or window casings where a straight line is crucial.

There is a need for a paintbrush that would cut down on touchups that are routinely done at the end of construction when all the permanent light fixtures are mounted into place. There is a further need to have replaceable bristles so as not to have to throw the whole paintbrush away when the bristles have reached the point of no longer suitable of achieving a professional job. There is also a need to ensure that the paintbrush parts are detachable including battery, on/off switch, light pack, clear lens, and main paintbrush handle. There is a further need to protect the lights on a paintbrush as the lights, wires, and power source, do not mix with cleaning fluids, including water and solvents and to make cleanup as simple as possible.

SUMMARY

The present invention provides a light pack for a paintbrush, wherein the paintbrush comprises a handle having a gripping end and a bristle end, and a plurality of bristles extending from the bristle end, the plurality of bristles having an edge to contact an object being painted, the light pack characterized by one or more lights disposed adjacent to at least one side of the handle and aimed to emit light at an angle toward the edge when the bristles are bent when an object is painted.

The present invention also provides a lighted paintbrush apparatus characterized by: (a) a handle having a gripping end and a bristle end; (b) a plurality of bristles extending from the bristle end, the plurality of bristles having an edge to contact an object being painted; and (c) a light pack comprising one or more lights disposed adjacent to at least one side of the handle and aimed to emit light at an angle toward the edge when the bristles are bent when an object is painted; wherein the bristle end is removably securable to a bristle apparatus having plurality of bristles extendable from the bristle end.

The present invention further provides a paintbrush holder for a paintbrush, the paintbrush comprising a handle with a widened bristle end, a narrow handle body and an enlarged gripping end, the paintbrush holder characterized by: (a) a clamp for removably securing the paintbrush holder to a top edge of a paint can; and (b) a saddle support coupled to the clamp and suspended over the paint can, the saddle support having an opening larger than the narrow handle body and smaller than the enlarged gripping end, enabling the paintbrush to be suspended from the saddle support at its enlarged gripping end and held within the paint can.

The present invention still further provides a paint can lid having a receiving means adapted to fit around the handle of a paintbrush.

In another aspect, the present invention provides a light pack for a paintbrush, the light pack including one or more magnets for attaching the light pack to any paintbrush having a ferrule or metal band connecting a handle and bristles of the paintbrush together.

In one embodiment, the light pack includes at least one magnet for detachably fastening the light pack to the ferrule of the paintbrush.

In another embodiment, the light pack preferably includes a lip which engages a shoulder portion of the paintbrush handle to allow the light pack to be installed quickly and consistently each time on the same location of the ferrule for a particular paint brush.

In another embodiment, the light pack includes a waterproof or water resistant shell to enclose a plurality of light emitting diodes (LEDs), lighting circuitry including a switch, and one or more batteries to power the LEDs.

In still another embodiment, a lighting switch is provided to turn a light on, off or change lighting intensities.

In this respect, before explaining at least one embodiment of the system and method of the present disclosure in detail, it is to be understood that the present system and method is not limited in its application to the details of construction and to the arrangements of the components set forth in the following description or illustrated in the drawings. The present system and method is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein.

Figure 1:
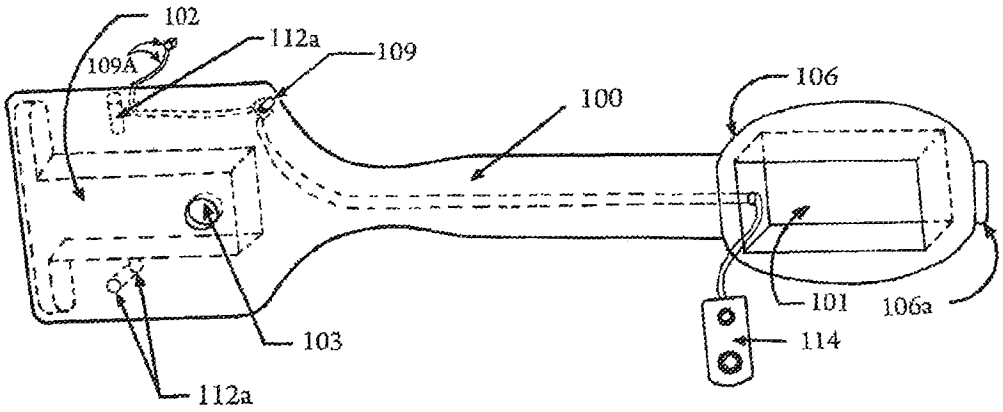
FIG. 1 illustrates the brush handle according to one embodiment of the present invention.
Figure 1A:
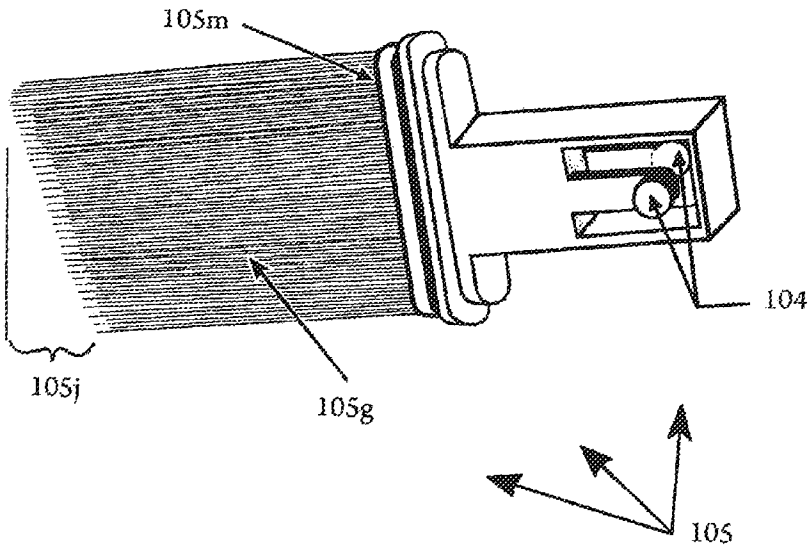
FIG. 1*a* illustrates the bristle apparatus according to one bristle embodiment for the brush handle illustrated in FIG. 1.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

The present invention discloses a light pack for a lighted paintbrush. The light for the lighted paintbrush and light pack may be provided by one or more LEDs (213), but could be incandescent, fluorescent, halogen or other light types. The light pack is adapted to attach to a paint brush by various attachment means.

The present invention further discloses a brush holder for a paintbrush which may be the lighted paintbrush. The brush holder is adapted to clamp to a paint can. The present invention also provides a flexible plastic paint can lid (120) with a slot in it for use with the brush holder.

The lighted paintbrush of the present invention lights up the work area for the painter when cutting in to any object such as borders, window or door casing, or any trim that is a different color from the paint that he is using. The light provided by the lighted paintbrush includes a plurality of lights that may be aimed at an area around one or more sides of the paintbrush's bristles and at an angle which may compensate for where the edge of the bent brush bristles will be touching (the object being painted) when pressure is put on the brush.

The lighted paintbrush may be designed around the typical shape and style of a cutting-in paintbrush and may vary in size. The brush holder may be designed to work with the lighted paintbrush to keep it accessible, moist and free of dirt and paint build-up.

One aspect of the present invention is to add light directly to a painter's work area, generated from a light pack attachment on the paintbrush. Three aspects are disclosed but others are contemplated. In one aspect a new design of paintbrush with lights and bristle apparatus at one end and a power source, such as a battery, electrically linked to the lights at the other end of the handle is provided. In another aspect, a light pack of lights with an internal battery and switch which may include resistors if necessary are adapted to engage a standard style paintbrush. In a yet further embodiment, a removeably securable light pack with an internal battery and switch can be secured to the body of a prior art paintbrush.

Another aspect of the present invention is a brush holder that is adapted to engage a paint can, such as any regular sized one gallon (4 liter) paint can. The brush holder may be designed to hold the lighted paintbrush of the present invention or any standard style paintbrush equipped with an enlarged handle grip attachment.

A further aspect of the present invention is a flexible plastic paint can lid that may fit tightly to the top of a paint can, such as a regular 1 gallon (4 liter) paint can. The paint can lid may include a receiving means adapted to fit around the handle of either of the brush designs when the paintbrush is in the hanging position from the main saddle support of the brush holder. The lid is intended for extended or short periods of time when the brush is not in use, (e.g. lunch break), to keep the surface of the paint from skinning over and drying to the bristles at this location.

The present invention may also include an enlarged battery area at the end of the handle, with a battery pocket (101), and battery connector (114), as shown in FIG. 1, FIG. 2, FIG. 3, FIG. 4, and FIG. 13. The battery area and battery cover (115), also serves as a means of holding a paintbrush when not in use, by the use of the brush holder. Further, an enlarged handle grip is provided which may be the same or similar size and shape as the enlarged battery area on the lighted paintbrush and may be adapted to fit most standard style paintbrushes. The enlarged handle grip may also be designed to engage the brush holder.

The present invention also provides a clear lens (111) portion that supports the bristles (105*n*, FIG. 10) and virtually eliminates any paint from getting to the base of the bristles giving them a longer life. The clear lens portion may either be adapted to engage the lighted paintbrush or a standard style paintbrush. It is assembled around the main body of the paintbrush, and may be snapped together by means of a plastic self-hinge (116) on the lower part of the lens cover (111).

Another aspect of the present invention is a latex cover that may be rolled over the end of the handle, onto the light pack (113*a*), with the rim resting in a groove (110, FIG. 14) in the light pack to preserve the brush parts, sealing them from moisture and to help aid in cleaning. The latex cover may be designed to fit the lighted paintbrush of a standard style paintbrush with an enlarged handle grip. The latex cover may be designed with an enlarged end form fitted to the enlarged battery area on the end of the lighted paintbrush.

Figure 1B:
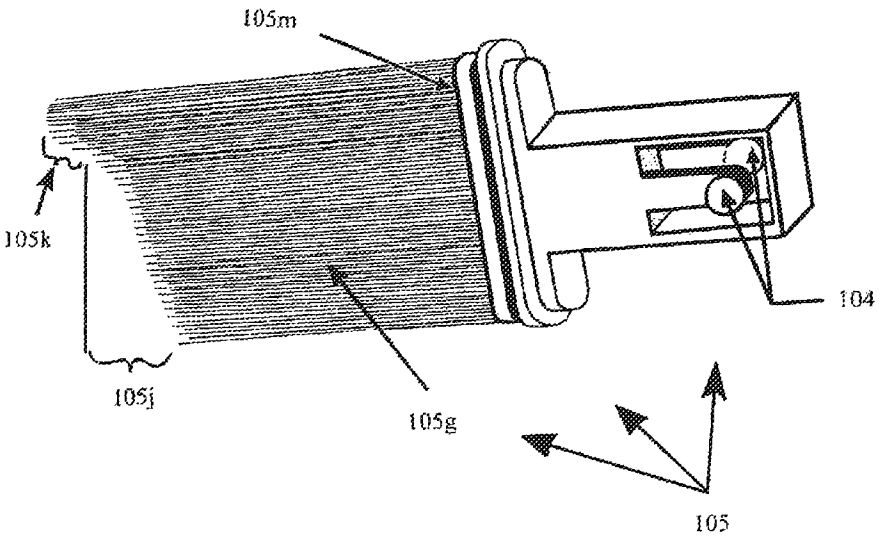
FIG. 1*b* illustrates the bristle apparatus according to a second bristle embodiment for the brush handle illustrated in FIG. 1.
Figure 1C:
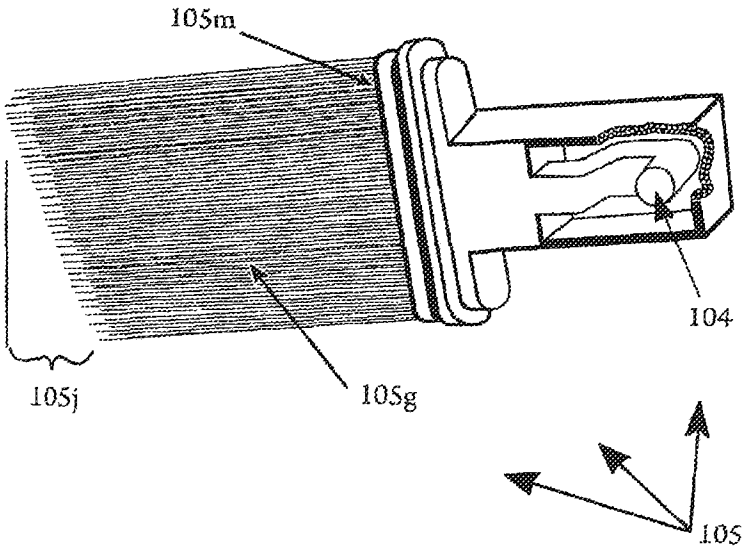
FIG. 1*c* illustrates the bristle apparatus according to one extension embodiment for the brush handle illustrated in FIG. 1.
Figure 1D:
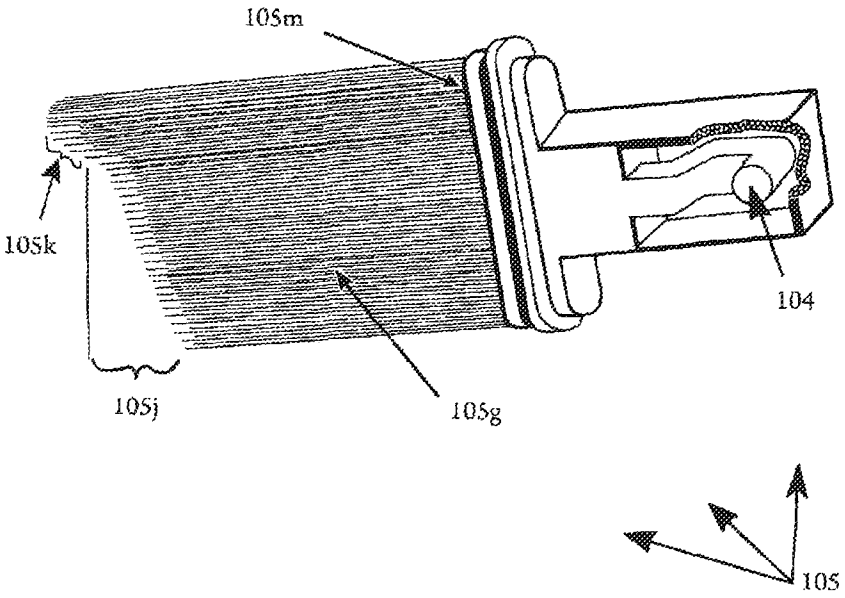
FIG. 1*d* illustrates the bristle apparatus according to a second embodiment for the brush handle illustrated in FIG. 1.
Figure 2:
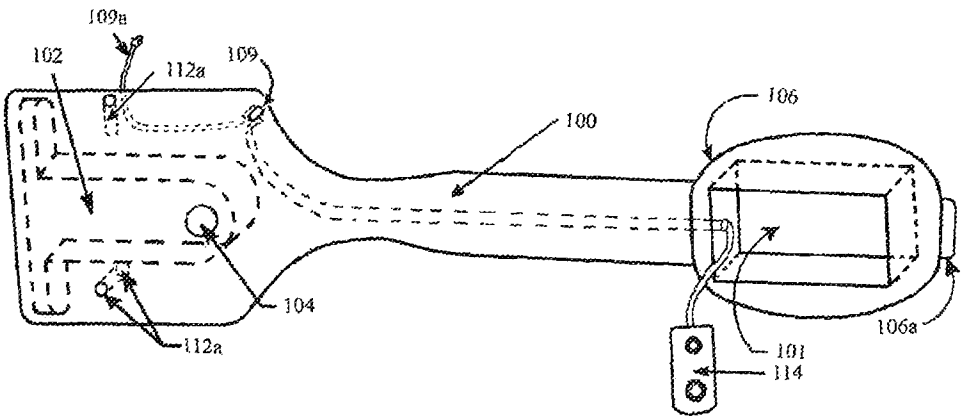
FIG. 2 illustrates the brush handle according to a second embodiment of the present invention.
Figure 2A:
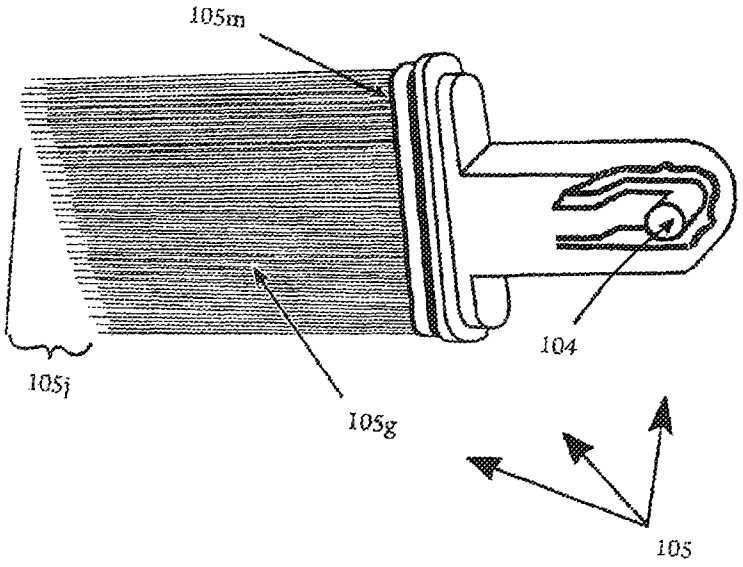
FIG. 2*a* illustrates the bristle apparatus according to one bristle embodiment for the brush handle illustrated in FIG. 2.
Figure 2B:
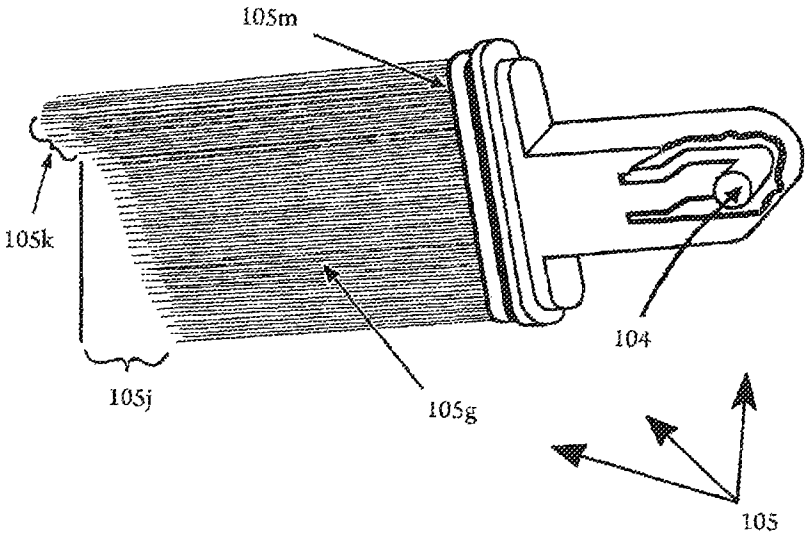
FIG. 2*b* illustrates the bristle apparatus according to a second bristle embodiment for the brush handle illustrated in FIG. 2.
Figure 3:
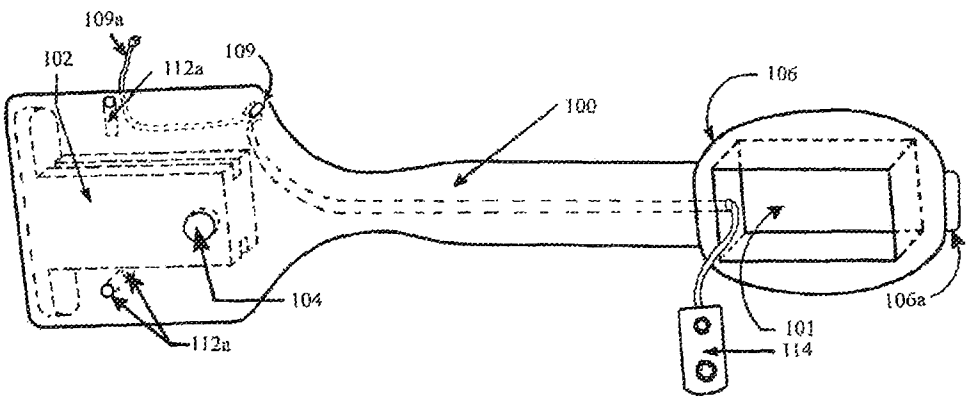
FIG. 3 illustrates the brush handle according to a third embodiment of the present invention.
Figure 3A:
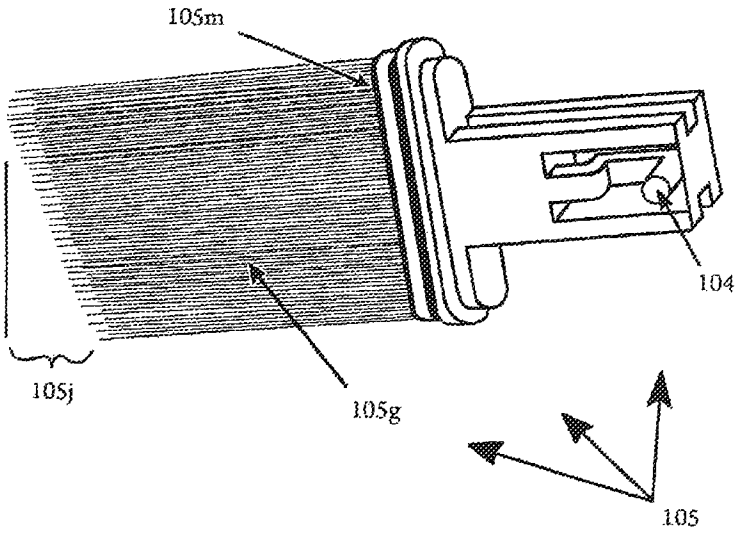
FIG. 3*a* illustrates the bristle apparatus according to one bristle embodiment for the brush handle illustrated in FIG. 3.
Figure 3B:
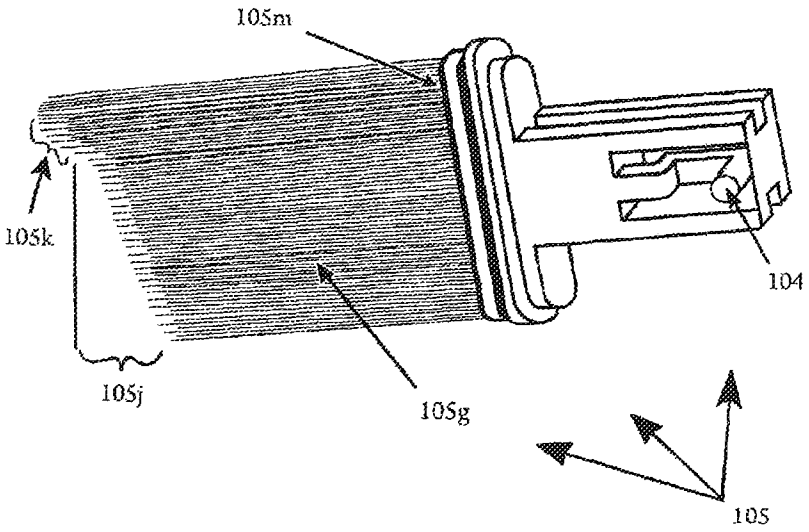
FIG. 3*b* illustrates the bristle apparatus according to a second bristle embodiment for the brush handle illustrated in FIG. 3.

In a further aspect of the present invention a removable bristle apparatus is disclosed to engage the lighted paintbrush. The bristle apparatus may aid in cleaning and ease of replacement when necessary, without discarding any other brush parts. The extension of the bristle apparatus may be made approx. 1/16 of an inch shorter than the cavity in the lighted paintbrush designed to receive the bristle apparatus. The brush bristles of the bristle apparatus may be tapered at the ends (105*j* and 105*k*, FIG. 3*b* and FIG. 1*b*), and one style may be designed for fine detail painting around jagged molding detail.

FIGS. 1, 2, 3 and 4 illustrate various embodiments of the lighted paintbrush body while FIGS. 1*a*, 1*b*, 1*c*, 1*d*, 2*a*, 2*b*, 3*a*, 3*b*, 4*a*, 4*b*, 4*c* and 4*d* illustrate alternative bristle configurations for the bristle apparatus.

Figure 5:
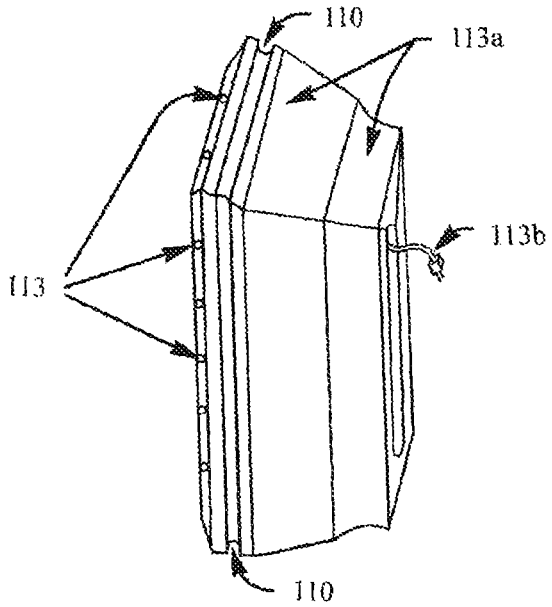
FIG. 5 illustrates the top perspective view of the light pack.
Figure 6:
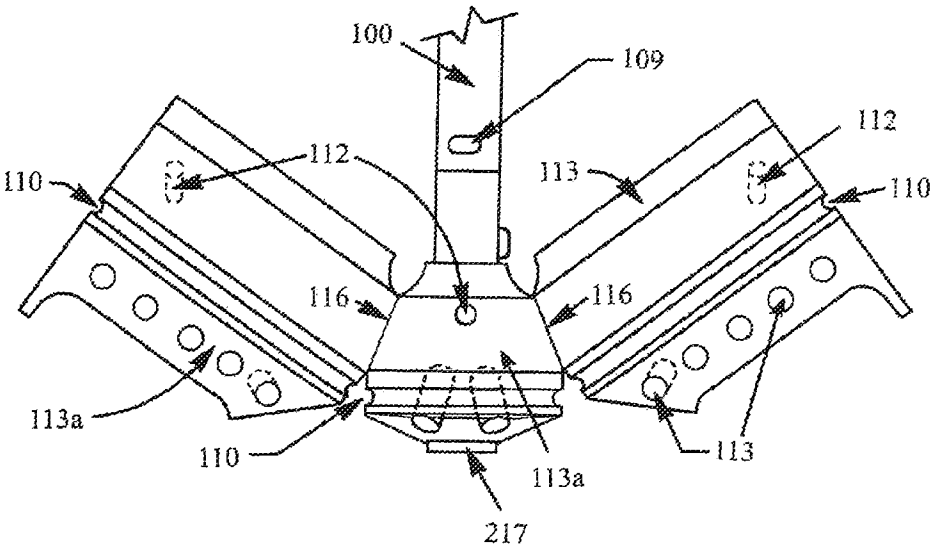
FIG. 6 illustrates the top view of the light pack in open position according to the present invention.
Figure 7:
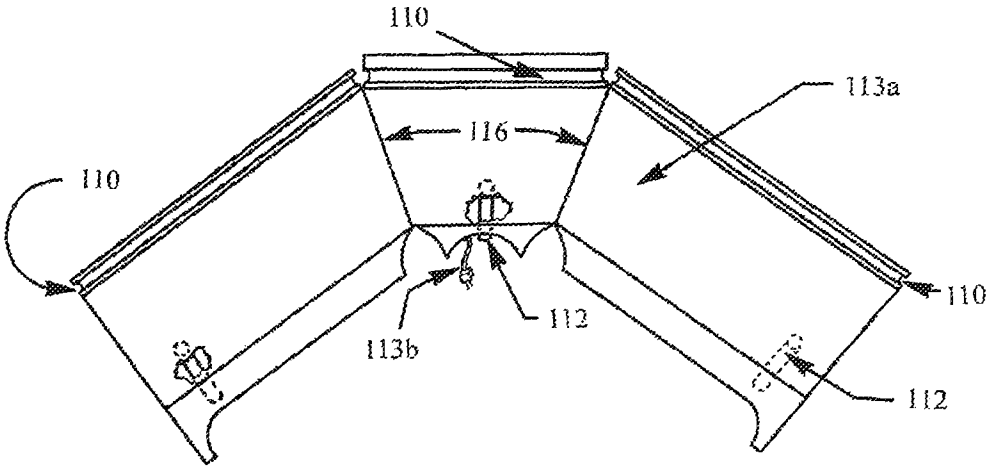
FIG. 7 illustrates the top back view of the light pack in open position.
Figure 8:
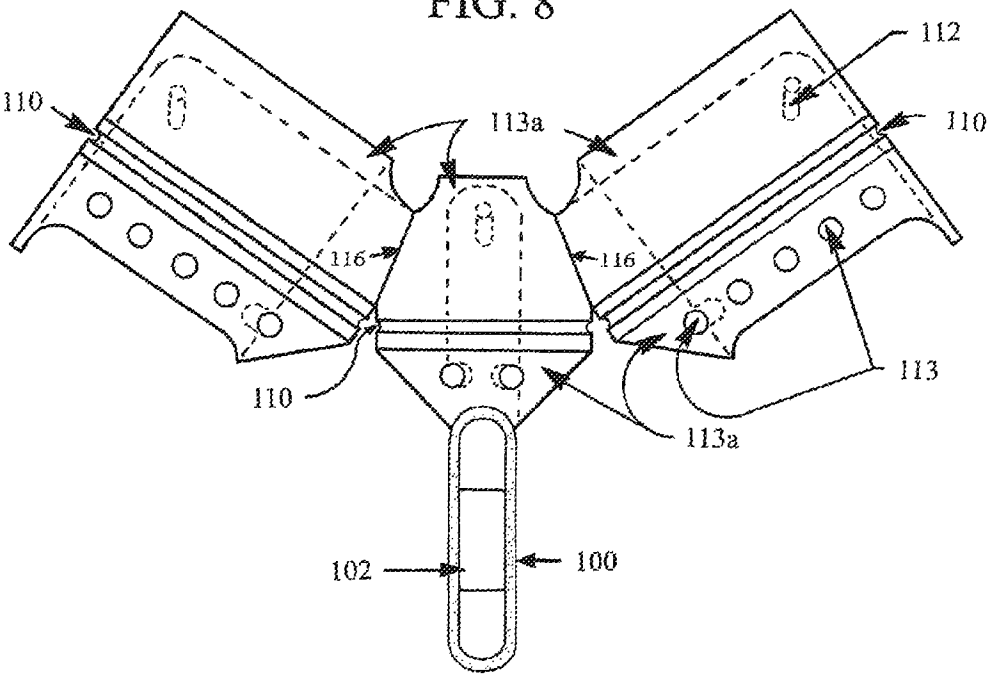
FIG. 8 illustrates the top front view of the light pack in open position.
Figure 9:
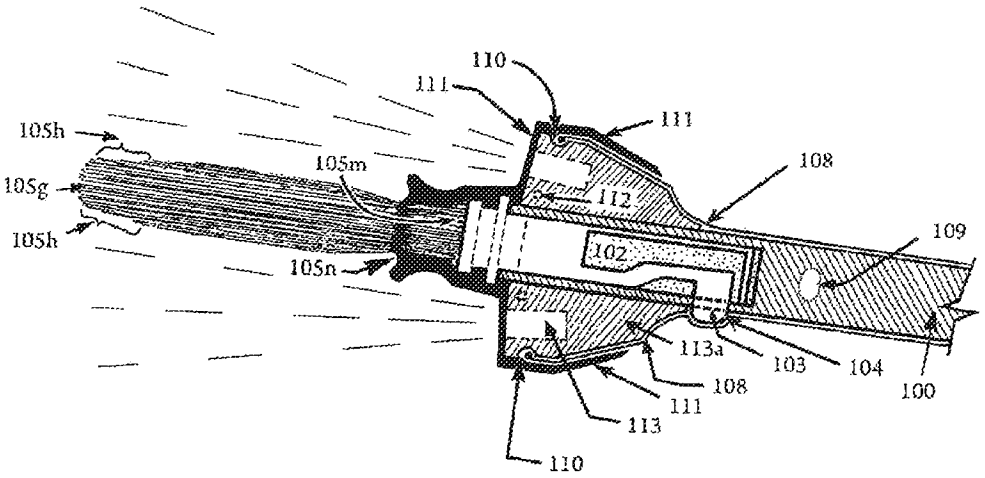
FIG. 9 illustrates a cross sectional view of the lighted paintbrush according to one embodiment of the present invention.

One aspect of the present invention is a light pack (113*a*), which is electrically connected to the battery by a connection (113*b*, FIG. 5), and is an attachment that fastens over the bristle end of a paintbrush handle, which is typically a widened part of a paintbrush handle, by snapping or by other fastening means into place on the handle. The light pack may fit tightly but removably around the brush handle and may be snapped into place by a plurality of locking pegs (112) on the light pack being pushed into tight fitting openings (112*a*) on the handle. A cross section of one embodiment of the present invention of the lighted paintbrush is illustrated in FIG. 9.

Figure 9A:
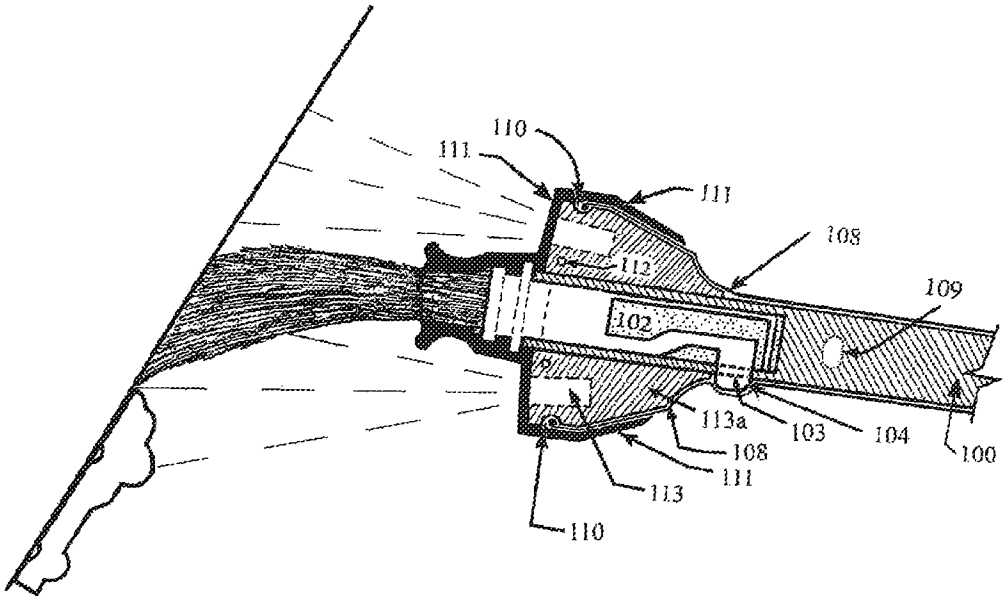
FIG. 9*a* illustrates a cross section view of the lighted paintbrush in painting action.

The paintbrush has a plurality of bristles extending from the handle at its bristle end. The plurality of bristles has an edge that contacts an object being painted. The light pack may include a plurality of lights that may be aimed at an area around one or more sides of the bristles and at an angle which may compensate for where the edge of the bent brush bristles will be touching (the object being painted) when pressure is put on the brush as shown in section view of FIG. 9*a*. Preferably, the light pack comprises a plurality of LED lights emitting light from three sides of the bristles, as shown.

Figure 10:
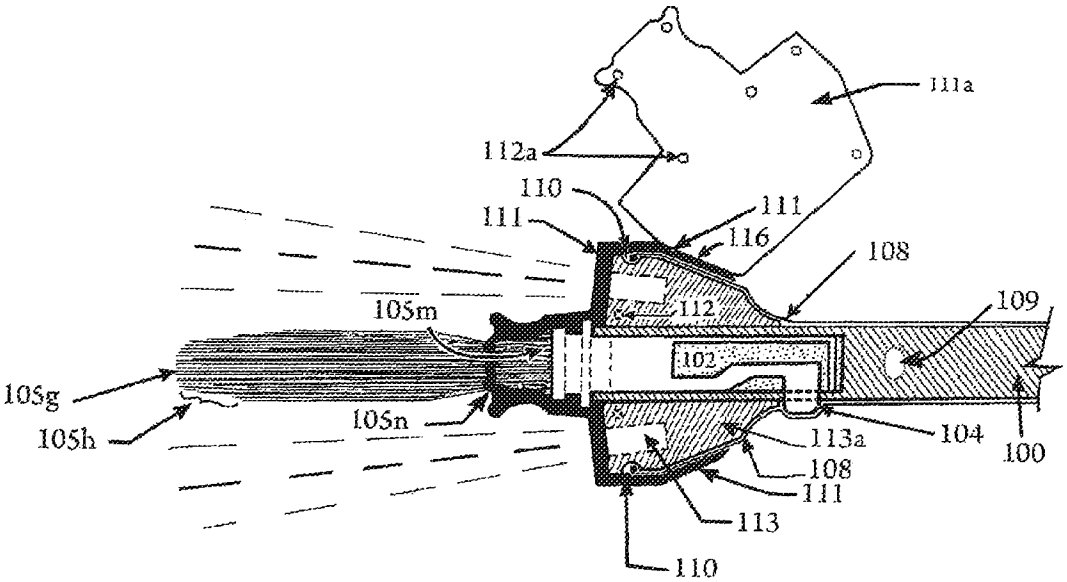
FIG. 10 illustrates a cross sectional view of the lighted paintbrush according to one embodiment of the present invention.

This slightly sideways pressure is put on the brush bristles in the typical style of painting and is a technique used to get a straight line while cutting-in tightly when painting any object. The lights (113) may be located on three sides of the bristles, the top edge as well as on both sides to ensure the possible use by a left-handed or right-handed painter. Other arrangements of lights are contemplated including lights on one, two or all four sides of the bristles. All lights may point slightly away from the edge of the bristles, when there is no pressure on the bristles as illustrated in FIG. 10. In the case of the actual painting process, pressure is put on the bristles, forcing the edge of the bristles (105*g*) to the location of the aimed lights as in FIG. 9*a*. These bright lights eliminate shadows that would be caused by the standard work light.

The lights may be switched on and off by a switch (109) conveniently located near the transition space from the narrow part of the handle that is gripped to the bristle end of the handle where the light pack is disposed, where the pointer finger naturally lands when holding a typical style paintbrush, whether the painter is left or right handed. Other locations of the switch (109) are contemplated. The series of lights may be attached to the light pack (113*a*), and may be easily separated from the main body and bristle apparatus (105) for easy cleaning and/or replacing. FIGS. 5 to 8 illustrate various angle of the light pack according to one embodiment of the present invention.

Figure 4:
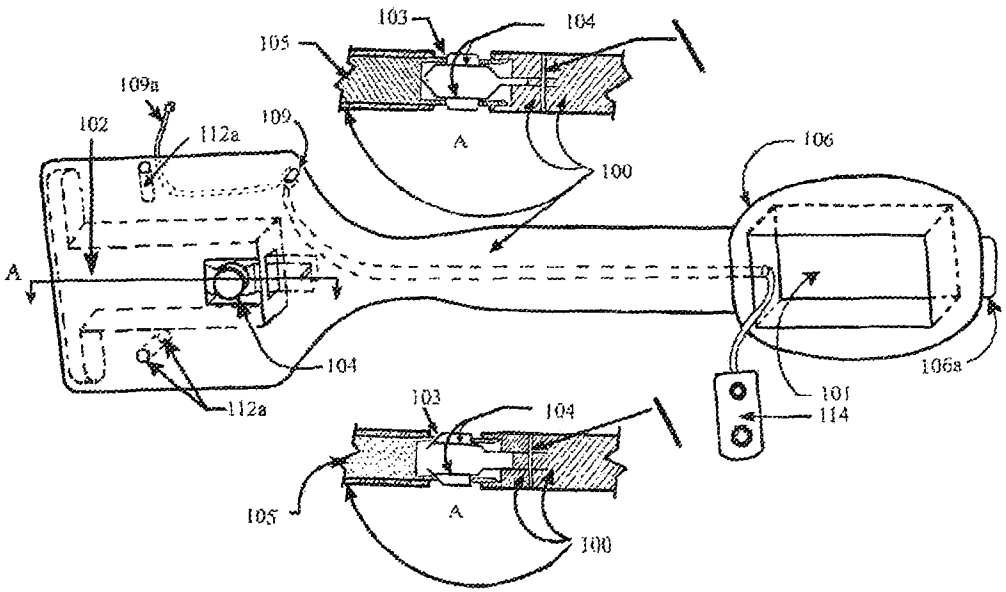
FIG. 4 illustrates the brush handle according to another embodiment of the present invention.
Figure 4A:
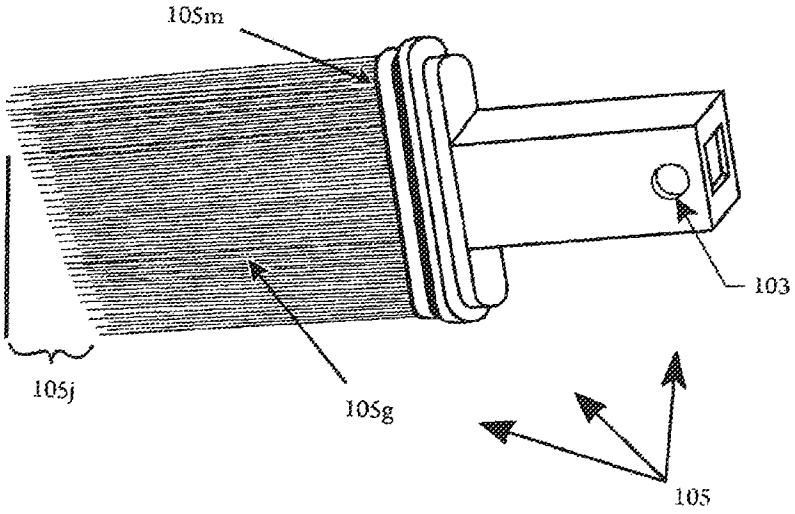
FIG. 4*a* illustrates the bristle apparatus according to one bristle embodiment for the brush handle illustrated in FIG. 4.
Figure 4B:
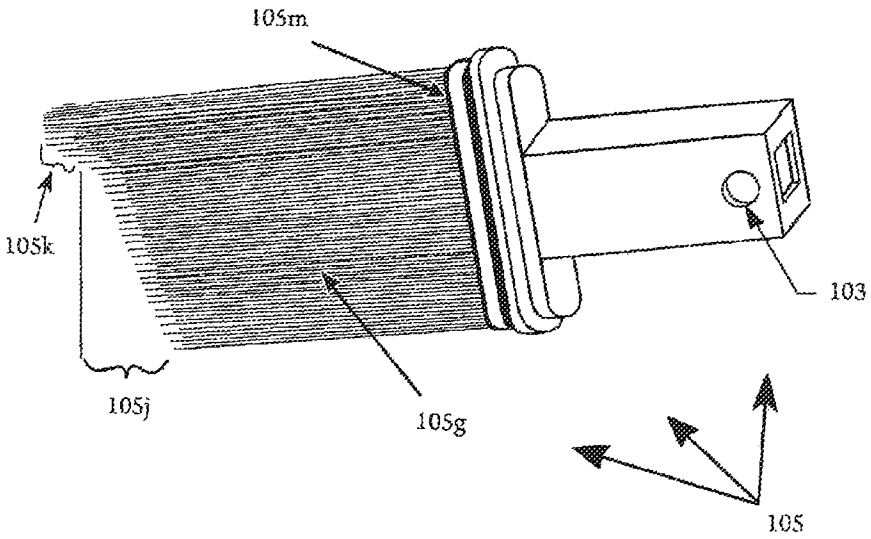
FIG. 4*b* illustrates the bristle apparatus according to a second bristle embodiment for the brush handle illustrated in FIG. 4.
Figure 4C:
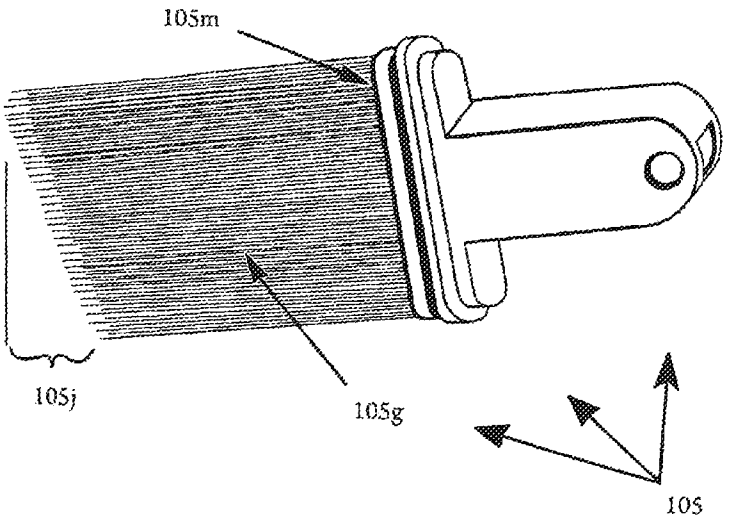
FIG. 4*c* illustrates the bristle apparatus according to one extension embodiment for the brush handle illustrated in FIG. 4.
Figure 4D:
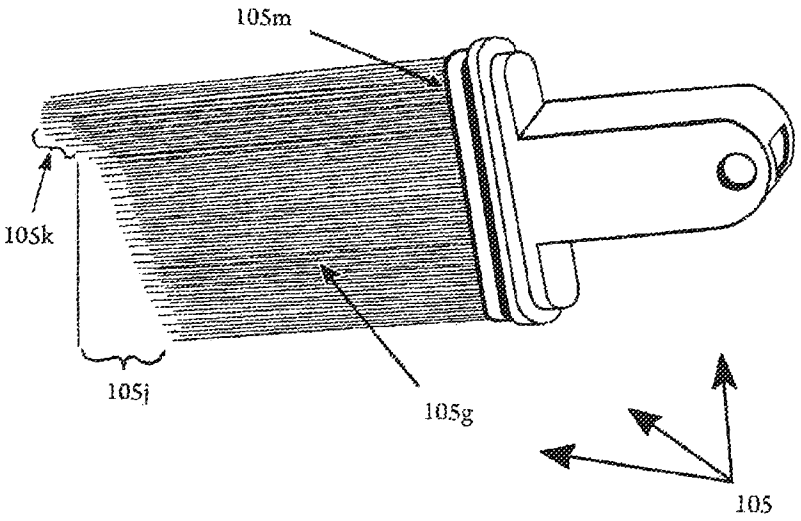
FIG. 4*d* illustrates the bristle apparatus according to a second embodiment for the brush handle illustrated in FIG. 4.

The handle (100) may be generally solid except for the battery pocket and lid, and an opening adapted to receive the bristle apparatus and may be molded as one piece. There may be an opening (103) on one or both sides of the bristle end of the handle that is adapted to engage and disengage the resilient arms (104) on the end of the bristle apparatus (105). FIG. 4 illustrates an alternative embodiment where the openings are located on the bristle end of the handle but the resilient arms are attached to the handle, not the bristle apparatus. The handle (100) may have a typical outer perimeter paintbrush shape and style for the most part, with the addition of the enlarged battery area (106), having an impact reinforcement (106*a*, FIG. 1), located at the end of the handle furthest from the end where the bristles get attached.

The enlarged battery area may allow the tip of the bristles to hang slightly dipped in approximately two inches of paint in the can when used with the brush holder (107). The moisture inside the paint can and the wicking of the paint covered bristles keeps the bristles moist, making it easier to paint straight, fine lines. The enlarged battery area also allows for a grip to initially pick up the brush from the brush holder.

The handle gripping has been designed around the enlarged battery area just mentioned and includes a comfortably shaped handle as well as a gripping feature, which may make use of a thin latex covering. The latex covering may be designed with an enlarged end form fitted to the enlarged battery area on the end of the lighted paintbrush (as shown in the side view of 108, FIG. 27).

Figure 11:
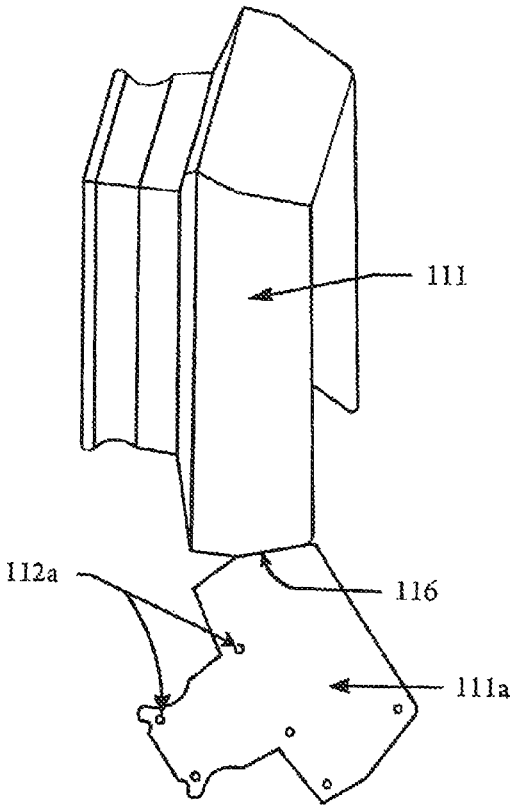
FIG. 11 illustrates the clear lens according to one embodiment of the present invention.
Figure 12:
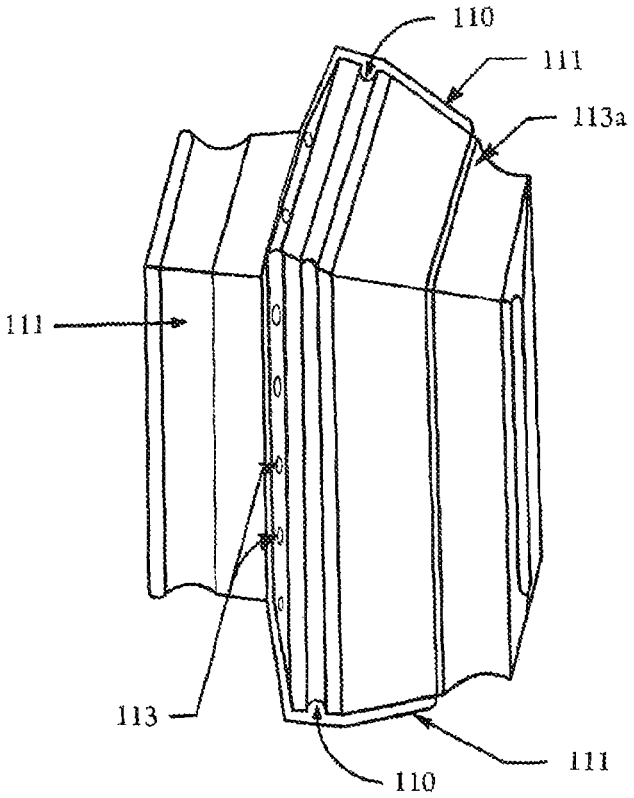
FIG. 12 illustrates the clear lens removably installed over the light pack.

The latex covering (108) may be rolled on from the end of the handle over top of the enlarged battery area, on/off light switch, and most of the light pack, ending at a groove in the light pack. The groove may hold the rim of the latex covering from rolling back off the light pack and to keep the rim out of the way of the tight fitting clear lens cover as illustrated in FIG. 11. The latex covering may be rolled on, over the brush assembly prior to the clear lens cover being removably installed over the light pack as illustrated in FIG. 12. The latex covering has three main features: 1) it gives a comfortable non-slip grip throughout; 2) it allows typical initial rinsing of the brush as is done in the cleaning process, keeping out moisture and paint from the on/off switch, light pack, battery, and wires which are not suitable to rinse without the latex covering; and 3) in case a brush was to be dropped in the paint or a spill on the handle, this ensures the brush may still be lightly rinsed similar to a typical paintbrush. After lightly rinsing the whole brush, the lens and bristles may be removed for further cleaning while the latex covering can be left on the main handle, keeping the parts inside it looking like new with no paint and fingerprint buildup. After several uses, the latex covering may be removed and a new one rolled on, ensuring anew grip and a moisture-resistant seal.

Another aspect of the present invention is a clear lens portion that may be removably installed by being slid over the base of the bristles (105*m*) and the forward portion of the light pack. The lens may cover and protect the lights. Preferably the clear lens should be constructed of transparent material but other material that is adequately translucent to allow the lights to sufficiently light the paint area are contemplated. The front part of the lens may squeeze tightly against the bristles (105*n*, FIG. 10), supporting them and sealing off any immediate moisture or paint from getting to the base of the bristles (105*m*). The back part of the lens fits snugly to the thin latex covering that may be rolled on over the brush assembly and light pack prior to the clear lens covering being removably installed.

When the clear lens is in place with three sides fitting tightly to the bristles, the aperture in the bristle apparatus and the thin latex covering over the light pack, the final side which may be hinged on one end, may be closed and snapped into place forming the final tight seal to the lower and final portion of the bristles. The bottom side (111*a* FIG. 11) of the lens cover has a plurality of receiving means. Preferably the lens cover will have 4 receiving means but a smaller or larger number is contemplated. At least one of these receiving means should be located in the bottom side of the clear lens and may fit tightly around the pegs in the bottom of the light pack. At least one of the receiving means will be adapted to fit around pegs in the bottom frontal portion of the clear lens. All the receiving means may be adapted to engage and disengage the pegs to create a tight fit. Ideally the receiving means should be bottomless so there is no chance of any dirt or paint building up inside them. In an alternative embodiment, two sides of the clear lens 111 may be molded slightly flared out for easier installation, since the bottom side of the lens cover 111*a* may pull the two tightly together when it is snapped shut. This completes the rectangle shape and the paint barrier to the base of the bristles on all sides.

For cleaning, once the clear lens is removed from the face of the light pack, the bristle apparatus may be easily removed. The light pack and latex covering may not need to be removed to remove the bristle apparatus but may be removable in the case of a spill or brush dropped into the paint by accident. The clear lens has three main purposes: 1) it protects the lights from paint splashed or splattered, making it easy to remove and clean and keeps paint out of hard to clean places which helps to keep the light pack lasting as long as possible; 2) the forward portion of the clear lens may fit tightly to and supports the bristles a distance away from the bristle base to form a barrier to any paint from getting close to the bristle base, which is more difficult to clean; and 3) the back portion of the snug-fitting lens may fit tightly to the latex covering overtop of the light pack, which allows this part of the brush area to be rinsed even though this part of the brush consists of parts such as lights, wires and a switch not normally suitable for rinsing.

Figure 33:
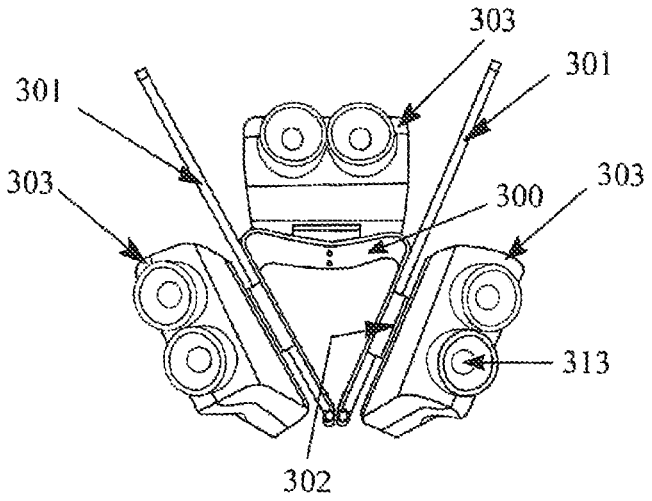
FIG. 33 illustrates an embodiment of the light pack that is removably securable to a paintbrush.
Figure 34:
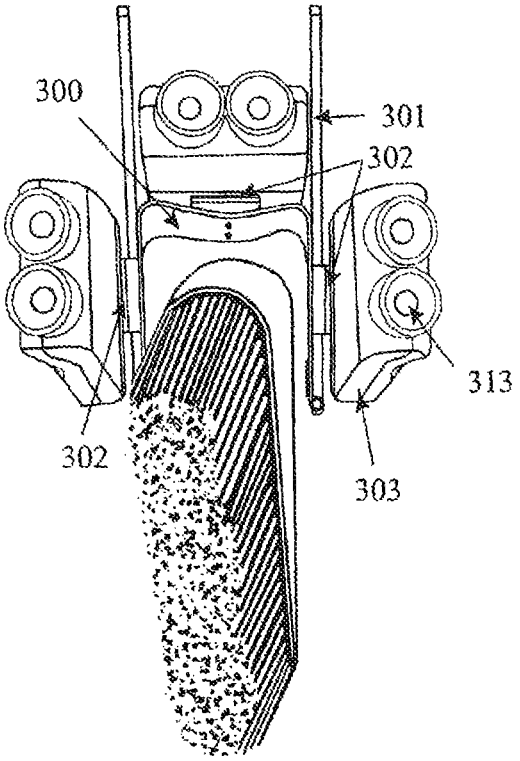
FIG. 34 illustrates the light pack, previously illustrated in FIG. 33, about to be secured to a paintbrush.
Figure 35:
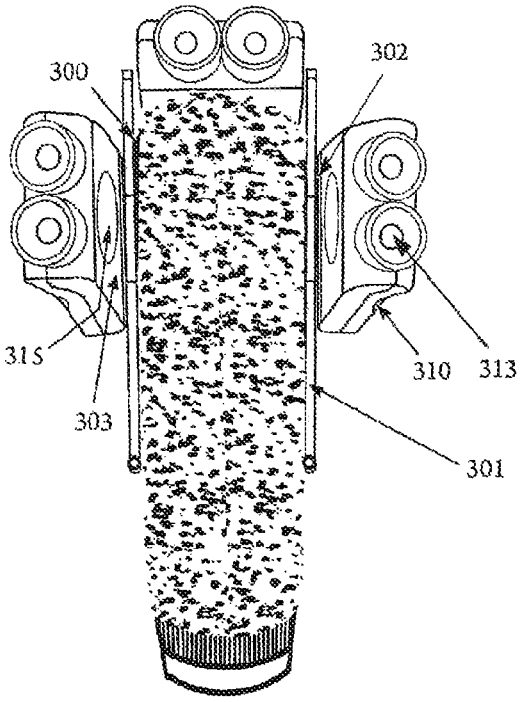
FIG. 35 illustrates the light pack, previously illustrated in FIG. 33, secured to a paintbrush.
Figure 41:
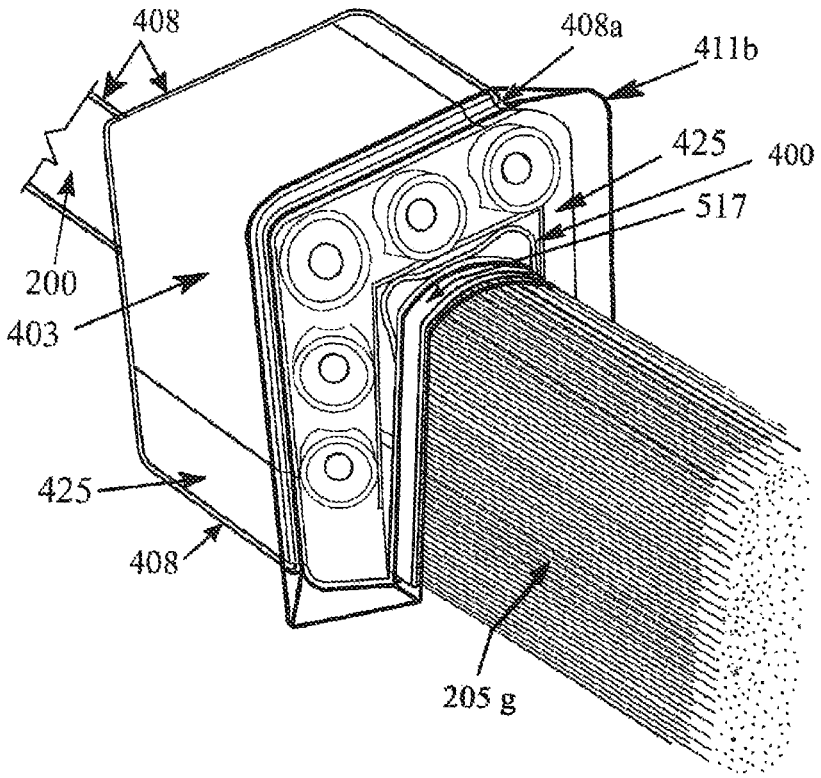
FIG. 41 illustrates another clear lens cover for the spring-steel clamp, previously illustrated in FIG. 36.
Figure 42:
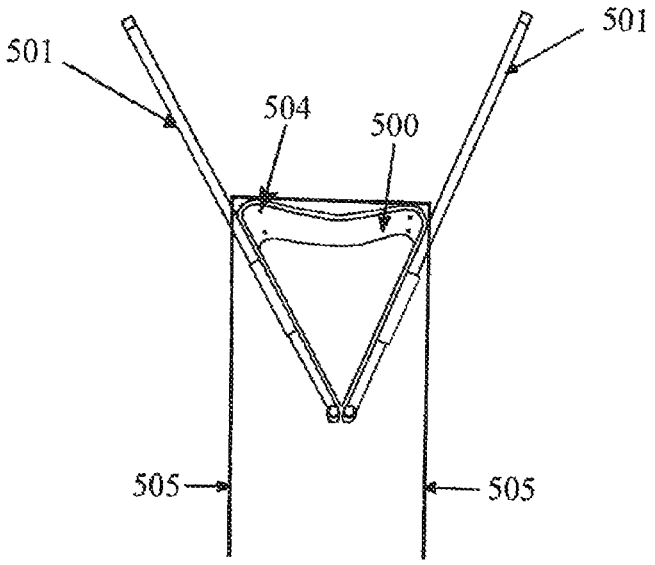
FIG. 42 illustrates another spring-steel clamp for removably securing a light pack to a paintbrush.
Figure 43:
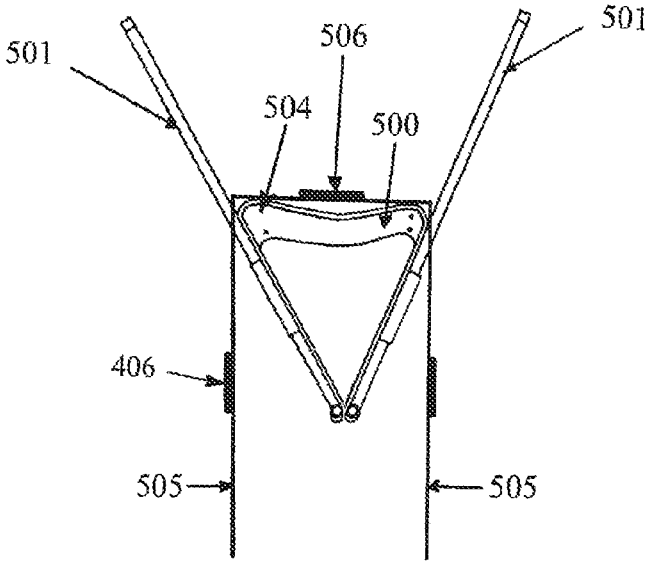
FIG. 43 illustrates means for securing lights to the spring-steel clamp previously illustrated in FIG. 41.

Three additional embodiments of the light pack are also provided: a second light pack (303) shown in FIGS. 33 to 35, a third light pack (403) shown in FIGS. 36 to 40, and a fourth light pack (503) shown in FIGS. 41 to 43. Preferably, the light packs comprise a plurality of LED lights (313,413,513) emitting light from three sides of the bristles.

The second light pack (303) is removably securable to a paintbrush by a spring-steel clamp. The light pack (303) may include a plurality of light pack components, each having an integral battery and a switch, preferably at the end opposite from the lights. After the three light packs are installed, the latex covering can be rolled on the brush handle up into the groove of each individual light pack (310). Though not shown in detail, the lens covers for each of the three light pack components may be slipped over the end of each light pack individually, and firmly held by the groove of each light pack (310), just over top of the rim of the latex covering. The three LED (or similar) light packs may be turned on and off individually and removed individually (for painting in space-restricted areas), leaving the other one or two operational. Each light pack component may be secured to a side of the spring-steel clamp (300), which has three sides, two opposing sides having extendable arms (301) that slide out for leverage for a person to open the clamp jaw so it can be placed on the typical paintbrush body. The extendable arms (301) can then be slid in (as shown in FIG. 35) to hide away for unobstructed handling once the jaws are clamped onto the paintbrush.

The end of the jaws may be tubular in shape (or rounded) to snugly clamp the paintbrush body, holding the clamp firmly in place, including a brush with various layers of paint residue covering the metal body of the paintbrush as a result of past jobs. The jaw ends may have a rubber coating on the jaws only, or metal teeth. The entire spring-steel clamp (300) may have a complete rubber or other frictional coating, with the exception of the fastening portion (302) that connects the spring-steel clamp (300) to the light pack (303).

The fastening portion (302) could be a slotted track on the underside of the light pack (303), and a corresponding "T" track on the spring-steel clamp (300). It should be noted that the fastening system holding the light pack (303) to the spring-steel clamp (300) could be altered to comprise one or more fasteners, such as magnets, Velcro/Dual Lock or similar material, adhesive or two-way tape, a snapping system of either metal (button style metal snaps) or of plastic (with a hole and peg for example), or any other form of fastening system. Each light pack component may be fastened in a similar way, so that any can be easily removed for painting of narrow areas close to corners.

An example of a battery cover (315) for the second light pack (303) is shown in FIG. 35. In this example each light pack component has its own batteries, however it is contemplated that more than one light pack component may share a common battery. An example of batteries that could fit in a light pack component includes, two or three 3-volt lithium batteries per two light pack components.

Figure 36:
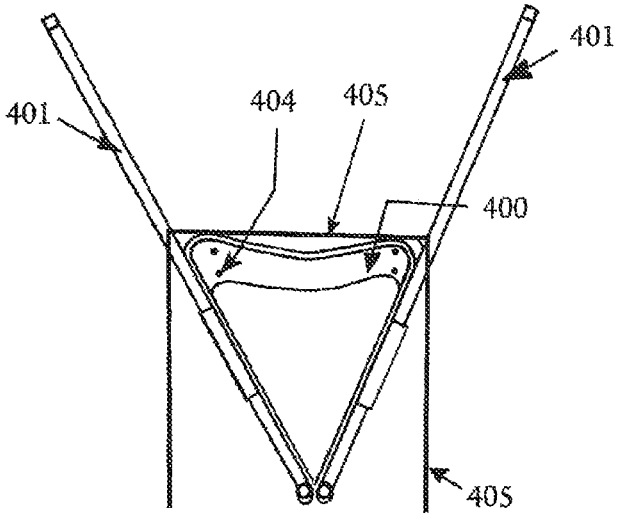
FIG. 36 illustrates a spring-steel clamp for removably securing a light pack to a paintbrush.
Figure 37:
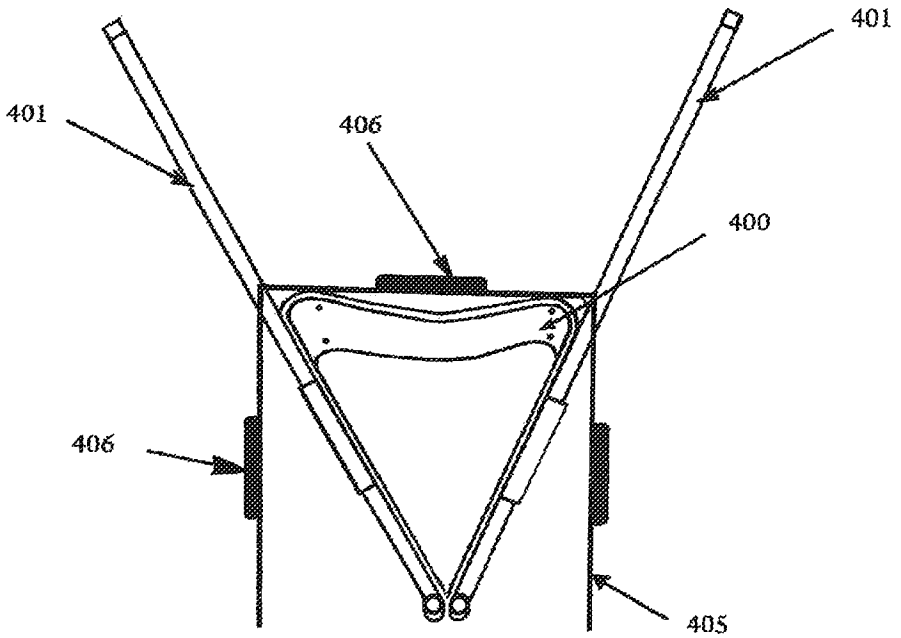
FIG. 37 illustrates means for securing lights to the spring-steel clamp previously illustrated in FIG. 36.
Figure 38:
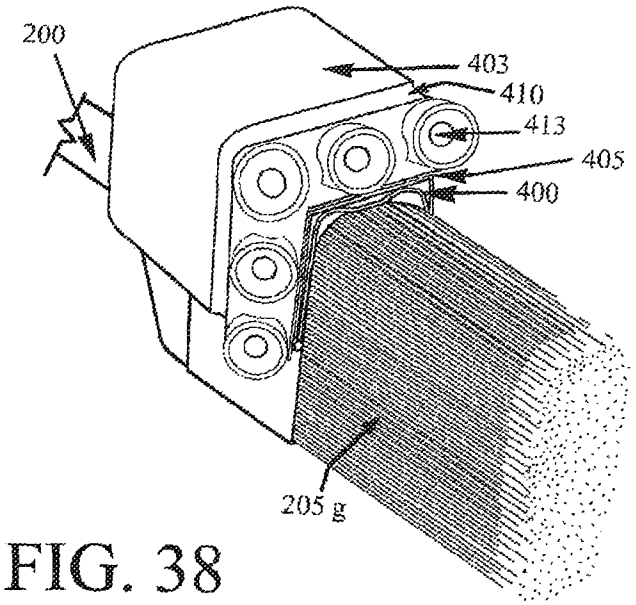
FIG. 38 illustrates the spring-steel clamp, previously illustrated in FIG. 36, with lights, secured to a paintbrush.
Figure 44:
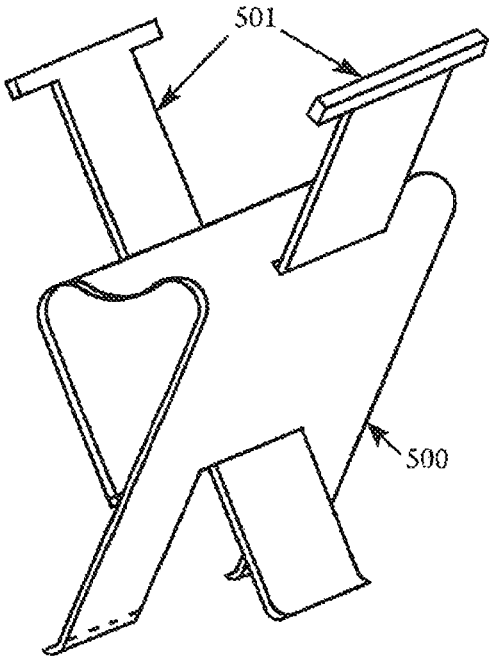
FIG. 44 illustrates another spring-steel clamp for removably securing a light pack to a paintbrush.

The third light pack (403) is an approximately "L" shaped (90 degree) one-piece light pack component that can be attached to either corner of a U-shaped outer shell of the spring-steel clamp previously described, or another similar type of clamp. The light pack is secured to the outer shell of the spring-steel clamp (400). The outer shell has three sides, two opposing sides having extendable arms (401) that slide out for leverage for a person to open the clamp jaw so it can be placed on the typical paintbrush body. The extendable arms (401) can then be slid in (pushed in, similar to the 303 light pack, as shown in FIG. 35). Once these extendable arms are pushed into place, the light pack can be attached to the spring-steel clamp's outer shell (405). The U-shaped outer shell (405) of the spring-steel clamp is shown in FIG. 36, FIG. 37 and FIG. 38. The L-shaped light pack component is shown on the right corner of the paintbrush as viewed by the painter. Although not shown in detail, the L-shaped light pack component is easily switched from one side of the paintbrush to the other, as needed for lighting to paint around a certain object. The L-shaped light pack component may be simply removed by an easily-removable fastening method, and reinstalled on the other corner of the U-shaped outer shell (405) of the spring-steel clamp (400). For example, the connection could be by one or more magnets (406) as shown in FIG. 37. Instead of magnets, the connection could also be Velcro or Dual Lock or similar material, or any other suitable fastening system that can easily be removed and reinstalled quickly. Any one, or combination of, these fastening systems may be used in conjunction with or without an interlocking shape to align the two pieces. Where five lights are provided, the center light of the 5 lights may be disposed on the L-shaped light pack component such that it is always the corner light, no matter whether it is placed on the right corner or left corner. FIG. 44 shows an alternate style clamp, with extended jaws, which could also be used inside of a U-shaped outer shell for more gripping power. A magnet on the back side of the Light Pack in a certain shape or location may be used in direct contact with the outer shell of the spring-steel clamp (400), as shown in FIG. 37. As shown in FIG. 36, the connection point (404) between the spring-steel clamp and the outer shell could be a weld, pop rivets, or any similar connection type. Not shown in detail, but a soft rubber or foam seal, similar to one shown in FIG. 46 and listed as (517) can be used with the light pack (403) and lens cover (411*b*) as shown in FIG. 41 to get a good seal between the lens cover and the bristle base.

Figure 39:
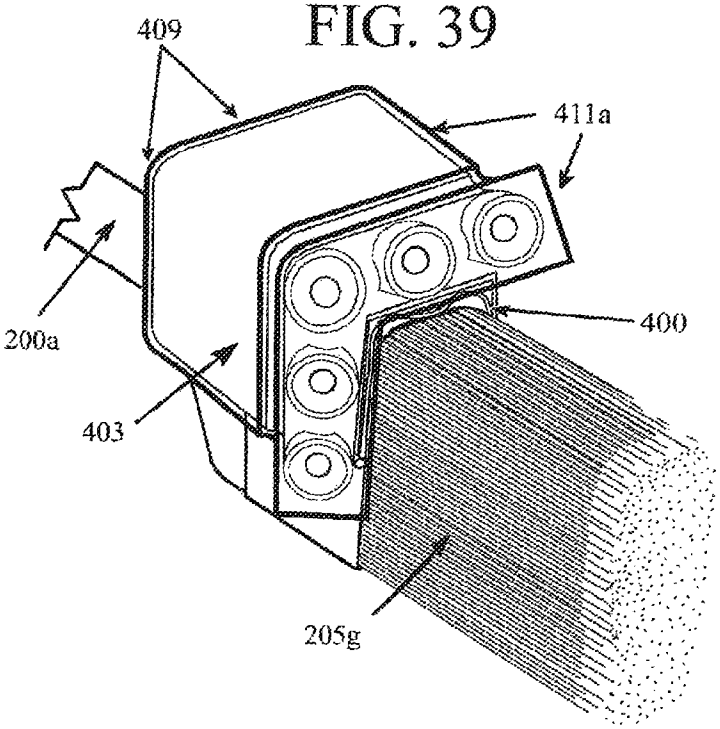
FIG. 39 illustrates a clear lens cover for the spring-steel clamp, previously illustrated in FIG. 36.
Figure 40:
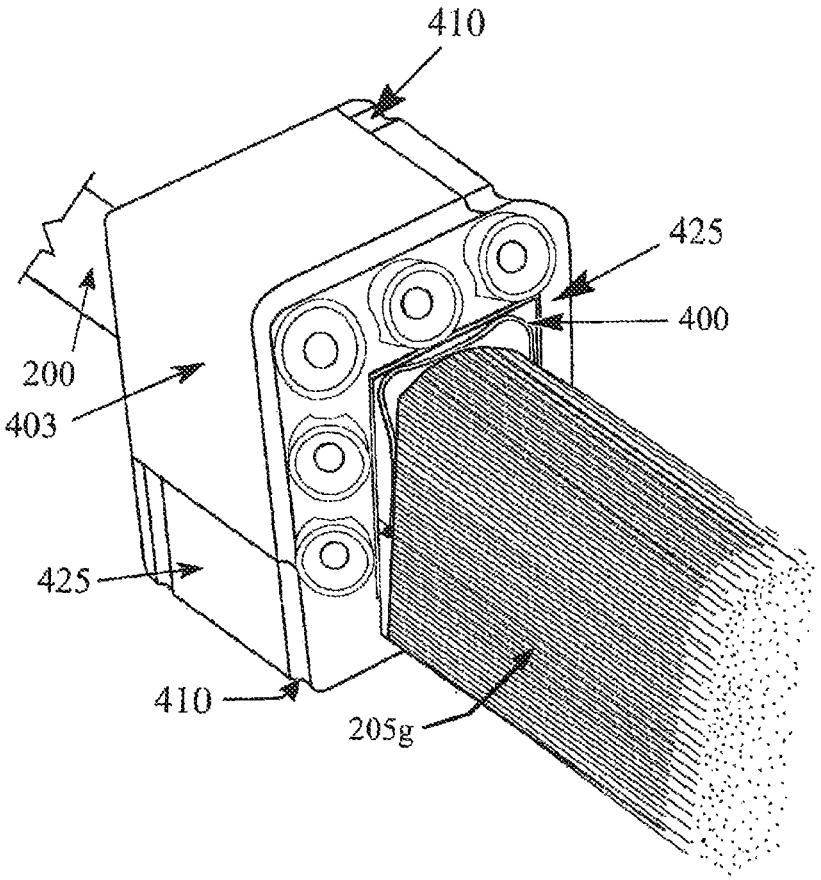
FIG. 40 illustrates a filler used for the spring-steel clamp previously illustrated in FIG. 36.

There are two types of lens covers that can be used with the L-shaped light pack component, a first lens cover (411*a*) and a second lens cover (411*b*), as shown in FIG. 39 and FIG. 41. The light pack and first lens cover, as shown in FIG. 39, enable easy removal and replacement from one corner to another of the paintbrush, and can be used without the rubber latex covering (408). The second lens cover, as shown in FIG. 41, may be installed over the L-shaped light pack component, which is shown installed on the right corner of the paintbrush, as held by the painter, is used in conjunction with the housing filler (425), shown in FIG. 40. Just as the L-shaped light pack component can be used on either the left or right corner, the housing filler can be flipped over to fit on the other corner of the paintbrush. The housing filler has two grooves (410); one for each position, providing a groove that lines up with the light pack groove (410) in either installation, and allows for a spot for the latex covering rim (408*a*) to rest, as shown in FIG. 41.

The third light pack (403) has its own self-contained batteries or custom-built battery pack, and a push-button on-off switch (409). Though not shown in detail, FIG. 39 shows the approximate location of the on-off switch at the end opposite from the lights.

Figure 46:
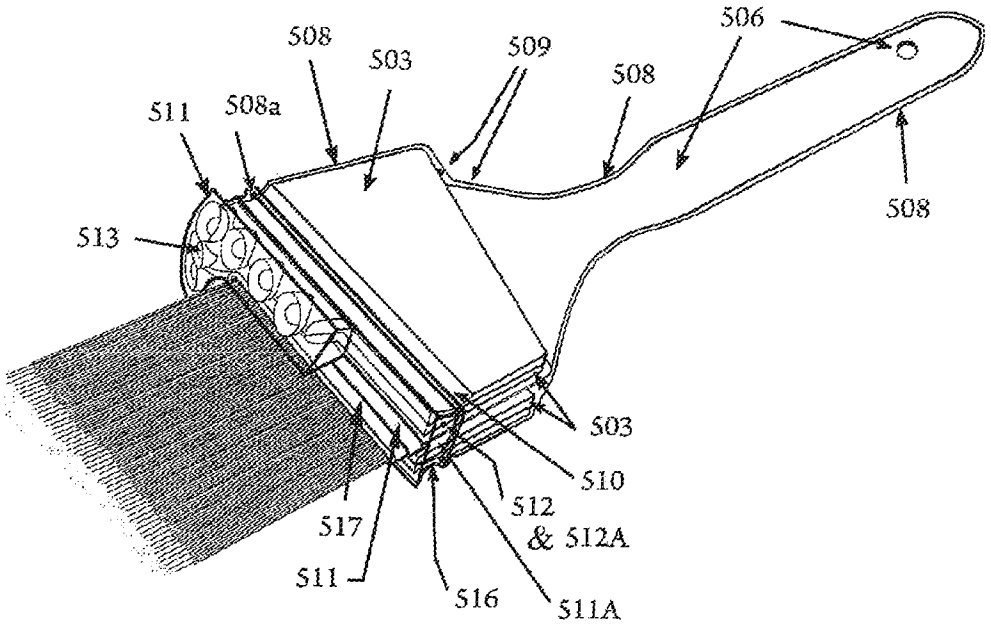
FIG. 46 illustrates a lens cover for a light pack secured to a paintbrush.

The fourth light pack (503) is attached in a similar method as the third light pack (403). The clamping system may be welded or pop-riveted (504) to the outer shell (505), and has the same characteristics as the one used for the third light pack (403), with the exception of the U-shaped Outer Shell having longer sides, which extend the full length of the side of the paintbrush, allowing more connection area, due to the fact the fourth light pack and battery area is much larger than the third light pack. The fourth light pack and battery area enables a larger battery system that can hold a charge longer. The battery system can be a lithium battery, a series of lithium batteries, or a custom-made battery pack installed on each side of the light pack, though the example in the diagram does not discuss a certain type of battery power. As shown in FIG. 46, the light pack (503) has its own clear lens cover (511), which is installed over the light pack and latex covering (508), which clamps tightly to the groove (510) and the rim of the latex covering (508*a*). The front of the lens cover fits tightly to a seal (517), such as a compressible rubber, foam or similar type of seal, having the same characteristics as the seal (217) described herein. The lens cover is preferably made of a clear plastic suitable to incorporate a self-hinge (516), locked into position on the lower part of the lens cover (511A) by a hole and peg system (512 and 512A, respectively). If a brush is used that has a thinner bristle base, the seal (517) makes up the difference of space between the bristles and the lens cover to still allow for a good seal against moisture. It also stops build-up of paint around the bristle base, where it is the hardest to get out when washing. The light pack (503) could also be made in a one-piece assembly that would slip over the narrow end of the brush handle and snugly fit against the widened part of the handle as it is slid down, or made in two pieces with a magnet at each narrow end top and bottom that when formed around the brush, attract each other and hold the Light Pack firmly in place around the paintbrush body.

FIG. 44 shows another spring-steel clamp (500) that could be used, in which the opposing sides of the spring-steel clamp mate. One side may have a recess while the other may have a protrusion substantially matching the size of the recess, such that when the spring-steel clamp is in its clamped position, the protrusion protrudes through the recess. This allows for stronger clamping while also having long sides. The clamp again has extendable arms (501).

Figure 45:
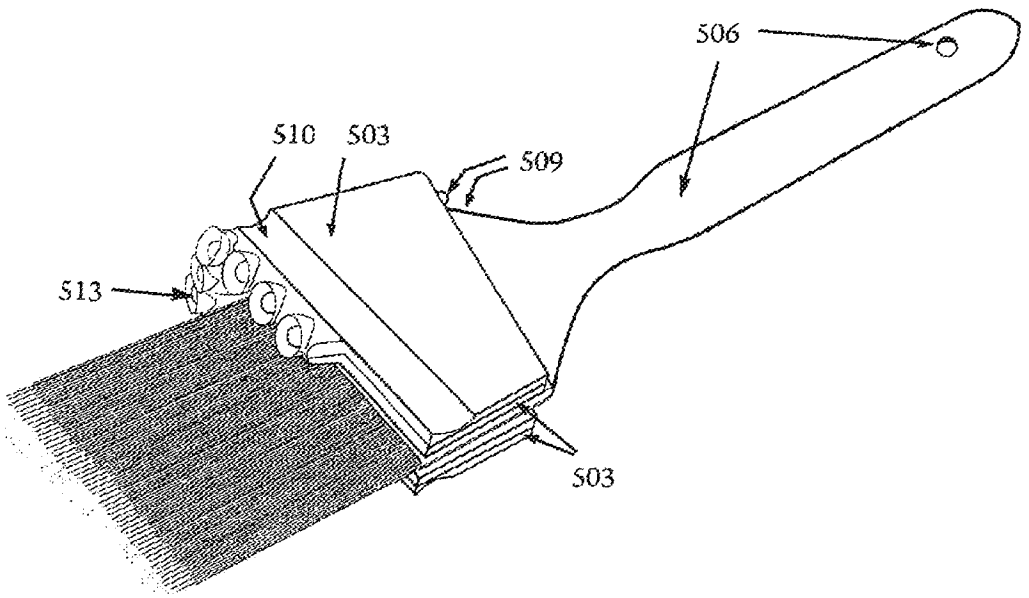
FIG. 45 illustrates a switch position operable with removably securable light pack.

FIG. 46 shows the location of an enlarged handle grip (506), which may be substantially similar to the enlarged handle grips (106, 206) described herein. The fourth light pack (503) may also include two on/off switches (509), similar to that previously described for a light pack integral with a paintbrush or a light pack removably securable to a paintbrush. The switches may be on either or both sides of the paintbrush, as shown in FIGS. 45 and 46. The left switch controls the left portion of the lights on the light pack, and the right switch controls the right portion of lights.

Any of the light pack embodiments may be constructed from plastic, light painted metal, stainless steel, or any other suitable materials to try to achieve a waterproof, rust-resistant assembly. The batteries provided therein may be one or more lithium battery, a custom-made battery pack that is rechargeable, or any other power source available or deemed suitable.

Due to the known fact that over time paint builds up at the base of the bristles making them stiff and that clean up liquids, lights, sockets, batteries, light switch and wires do not mix well, the present invention may include a detachable bristle apparatus. By allowing the bristle apparatus to be detachable the washing of the bristles may be done away from the lights and battery. The bristles may be in the shape of a bristle apparatus that may be detachable to allow a separation between the moisture and the lights and power source during the major cleaning or soaking the bristles. The bristles may be fastened to a molded base of the extensions, as shown in FIGS. 1*a*, 1*b*, 1*c*, 1*d*, 2*a*, 2*b*, 3*a*, 3*b*, 4*a*, 4*b*, 4*c* and 4*d*, with an adhesive, resin or epoxy, by an injection method or otherwise, to form together the bristle apparatus. The extension may be made approximately 1/16 of an inch shorter than the cavity in the handle which is adapted to receive the bristle apparatus. The extensions may be rectangular or oval in shape and may be held in place by the means of at least one resilient arm. In the various styles shown, the resilient arms may be attached to the bristle apparatus or the brush handle.

The bristle apparatus may be easily removed and washed out after the clear lens is removed from the face of the light pack. The bristle apparatus may be designed in a shape that still lends itself well to the use of a spinner. The extension of the bristle apparatus fits into the spinner in the similar manner a regular paintbrush would. The spinner is a tool commonly used by painters in the industry to remove virtually all the paint and moisture from the base of the bristles. Once the bristle apparatus has been detached and thoroughly washed out, the spinner may be attached to the bristle apparatus for the final cleaning process. The brush bristles may be tapered at the ends, or in the alternative, designed for fine detail painting around jagged molding detail.

Figure 13:
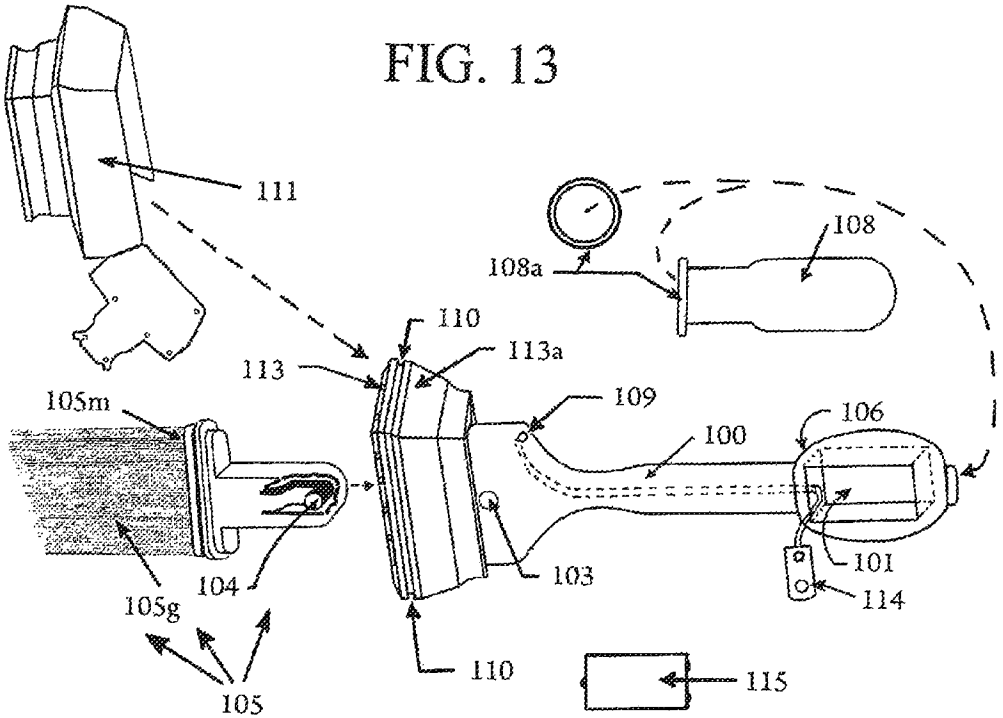
FIG. 13 illustrates the brush parts and assembly of the lighted paintbrush according to one embodiment of the present invention.
Figure 14:
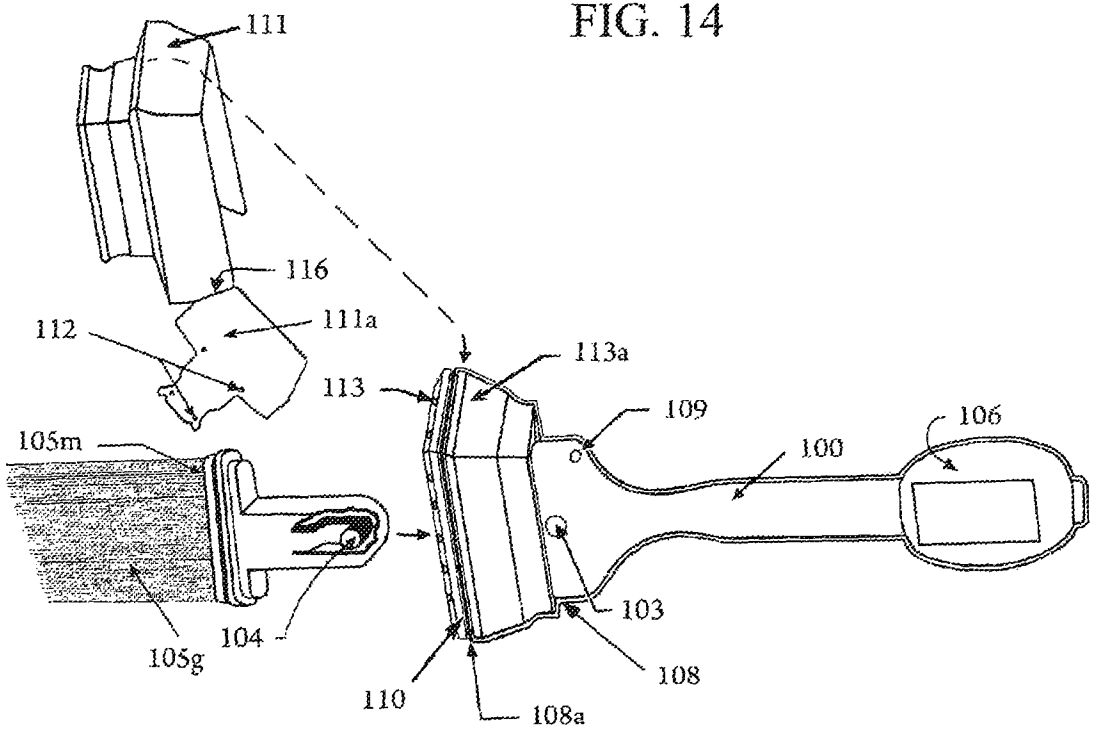
FIG. 14 illustrates the brush parts and assembly of the lighted paintbrush according to another embodiment of the present invention.
Figure 15:
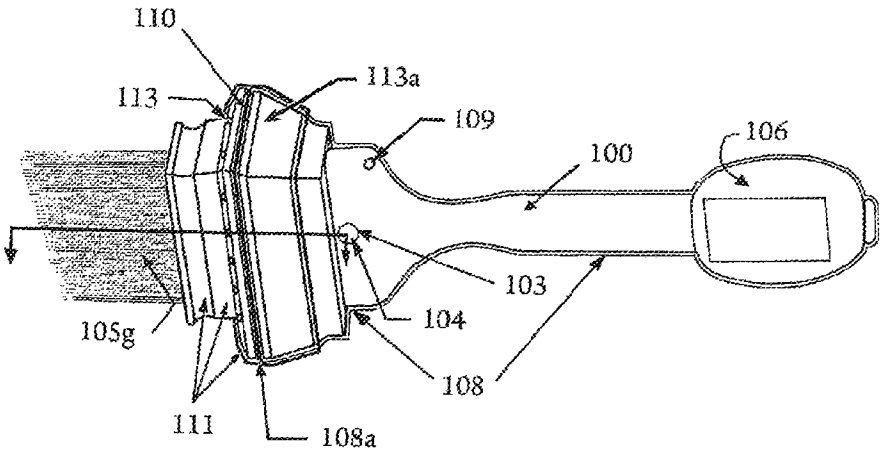
FIG. 15 illustrates the assembled lighted paintbrush according to one embodiment of the present invention.
Figure 16:
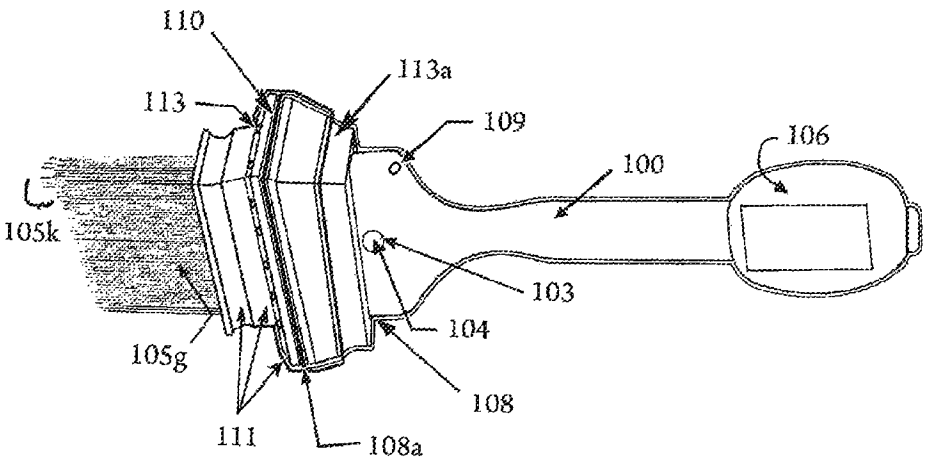
FIG. 16 illustrates the assembled lighted paintbrush according to another embodiment of the present invention.

FIGS. 13 and 14 illustrate the assembly of two separate embodiments of the present invention. The aspects of the present invention described above are illustrated as are their interactions with each other. FIGS. 15 and 16 illustrate the assembled lighted paintbrush according to two embodiments of the present invention.

Figure 17:
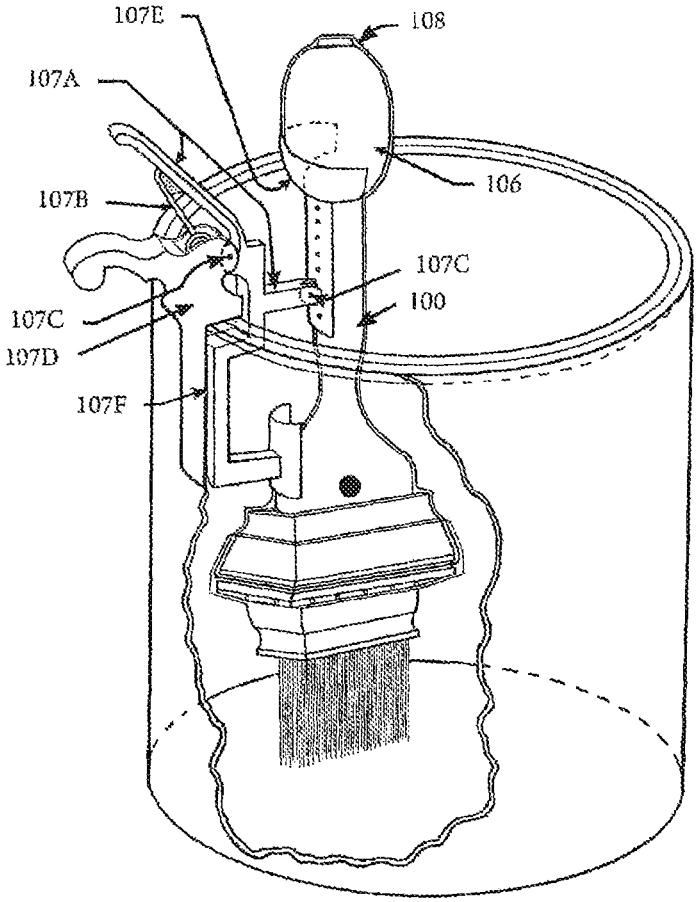
FIG. 17 illustrates the brush holder according to one aspect of the present invention.
Figure 18:
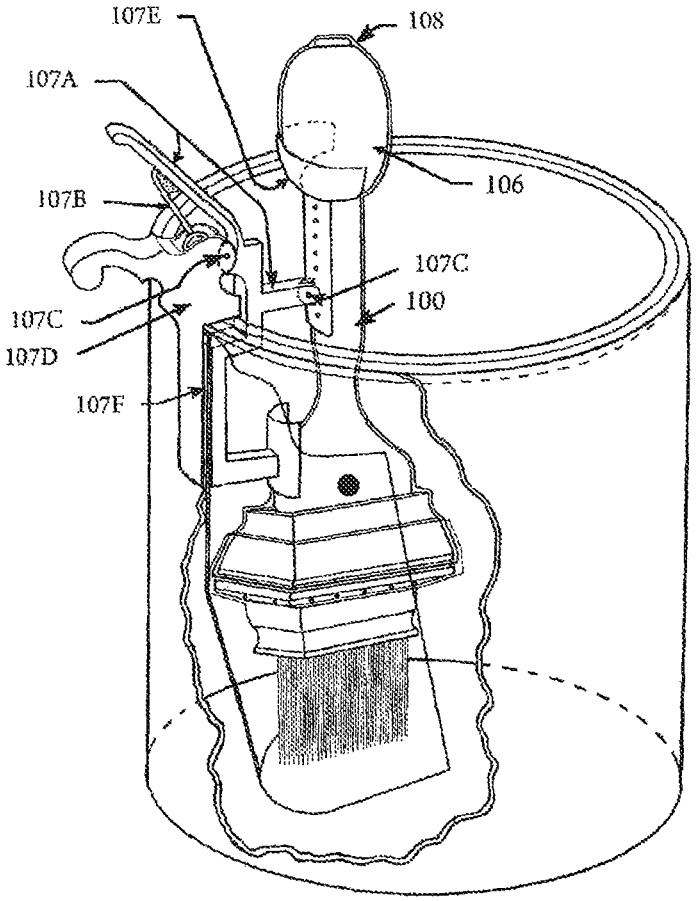
FIG. 18 illustrates the brush holder according to one aspect of the present invention with the added splash guard.
Figure 18A:
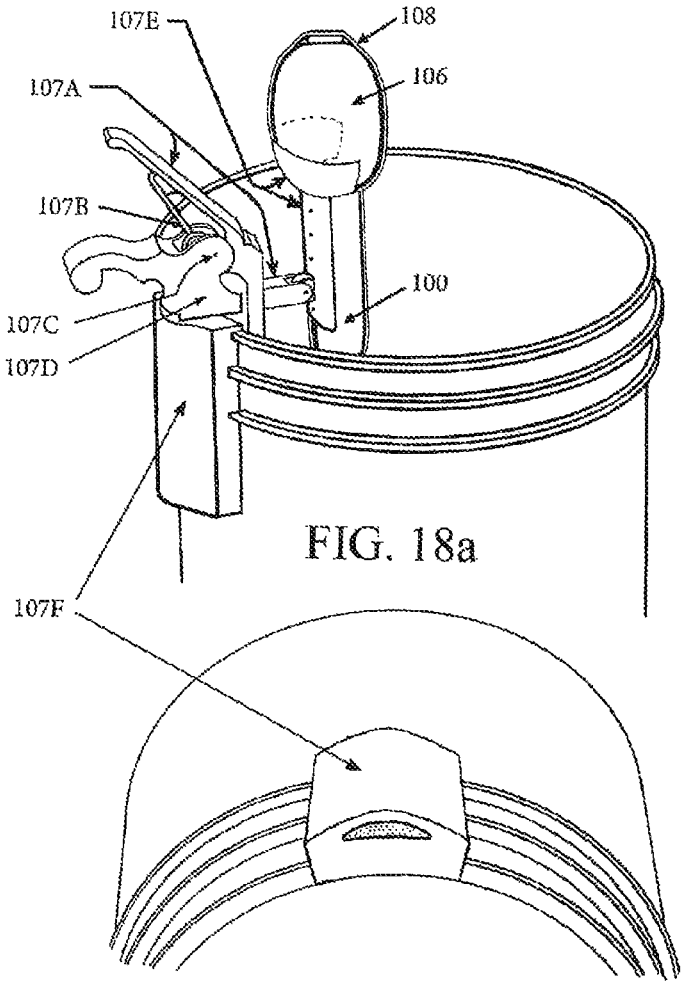
FIG. 18*a* illustrates the brush holder in accordance to one aspect of the present invention adapted to engage a plastic paint can.
Figure 19:
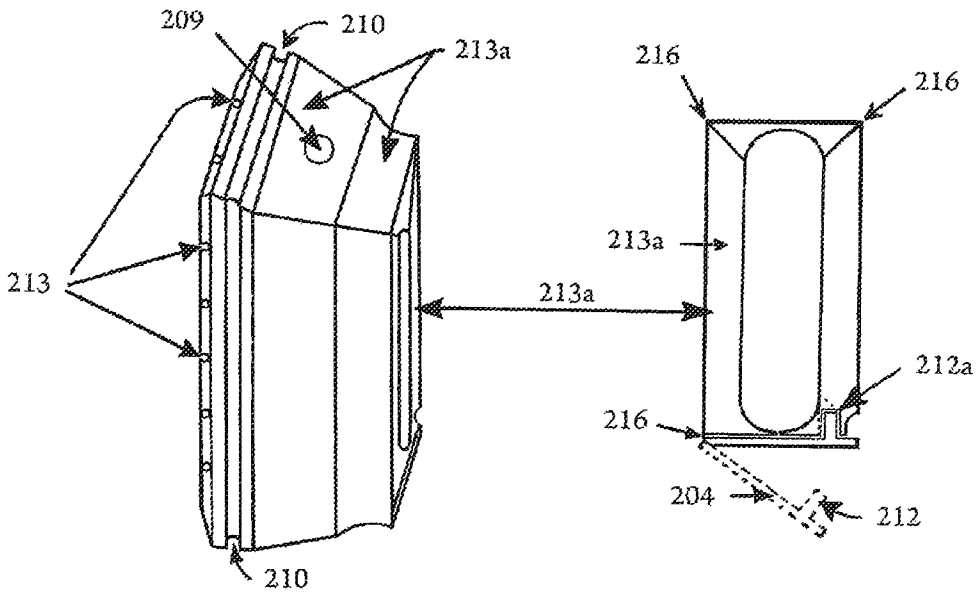
FIG. 19 illustrates the top perspective view of the light pack for a standard style paintbrush.
Figure 20:
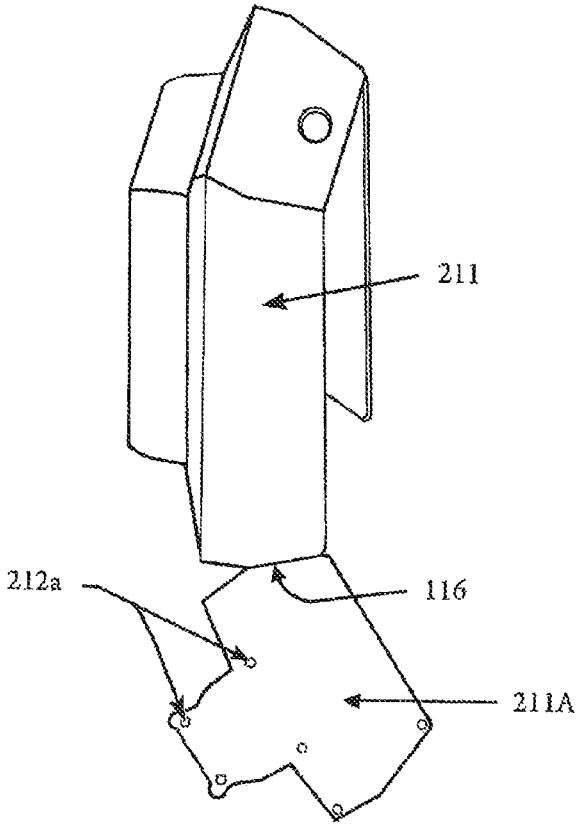
FIG. 20 illustrates the top perspective view of the clear lens for a standard style paintbrush.
Figure 21:
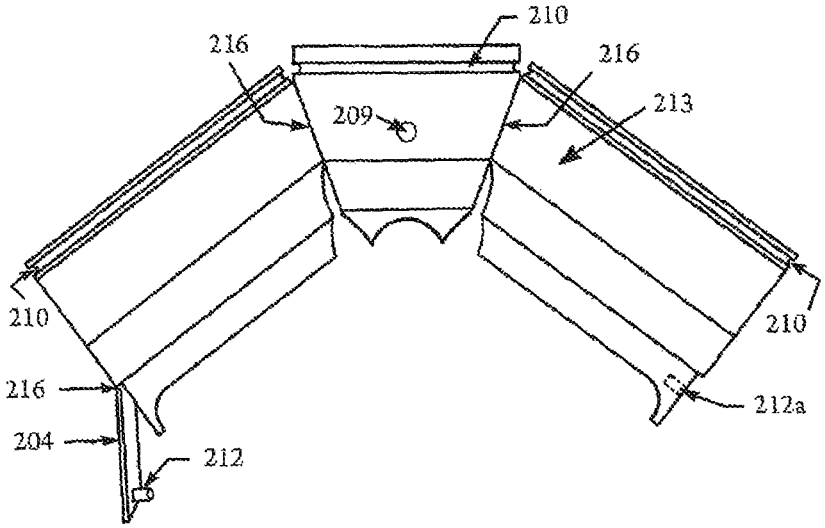
FIG. 21 illustrates the top back view of the light pack in open position for a standard style paintbrush.
Figure 22:
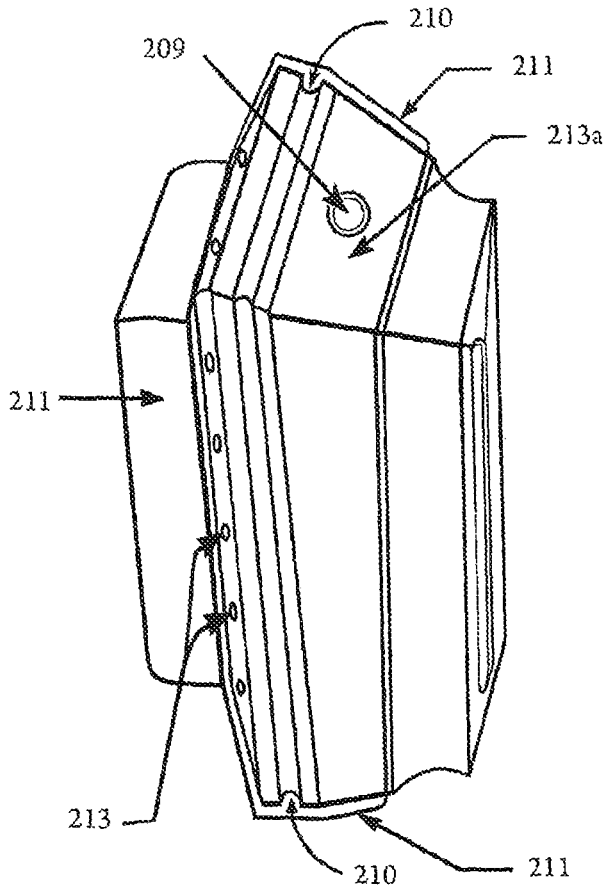
FIG. 22 illustrates the top perspective view of the clear lens removably installed over the light pack for a standard style paintbrush.

The brush holder 107 may be molded of plastic or lightweight metal and may clamp onto any regular one-gallon paint can. The brush holder may be able to be used with the lighted paintbrush or other paintbrush. The lighted paintbrush's enlarged battery area may hang in the brush holder main saddle support with bristles facing downwards, leaving the bristles slightly dipped in the paint at the bottom of the paint can as shown in FIGS. 17 and 18. As illustrated in FIG. 18*a* the paint can may be made from plastic having a unique rim structure. To accommodate the plastic paint can rim structure a non-slip rubber strip 107F may be included between the plastic paint can and the brush holder 107.

Figure 47:
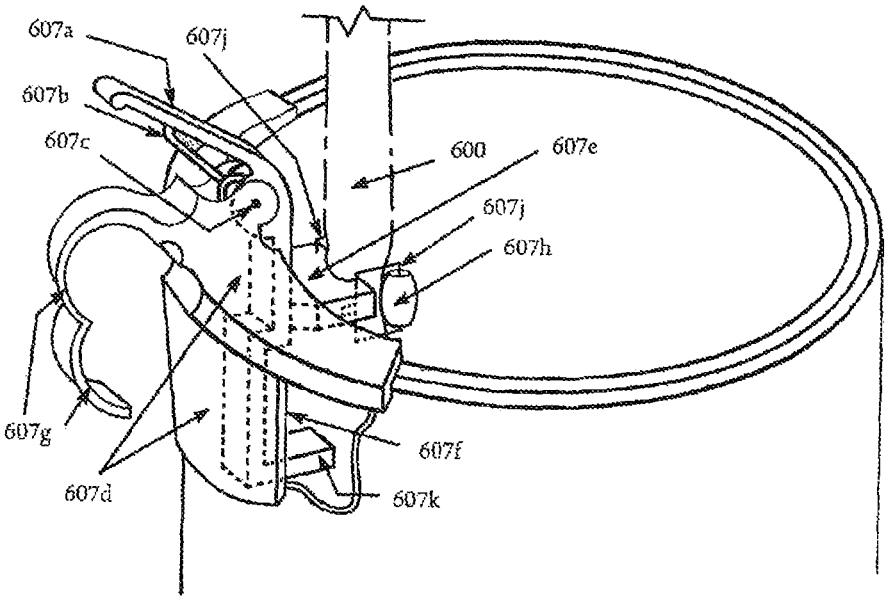
FIG. 47 illustrates another embodiment of the brush holder.

In another embodiment of a brush holder (607, FIG. 47), designed for a standard style paintbrush (600), the brush holder still clamps on by means of a spring (607*b*) hinging on a pin (607*c*), onto the paint can in a similar style as the previous embodiment, i.e. with an inside clamping arm (607*a*) with a lower brush support (607*k*), holding the paintbrush while not in use, but also serves as a handle (607*g*), as a way of holding or carrying the paint can. The outside clamping arm (607*d*) is much wider than the previous version, in order to give the holder added stability. The portion of the outside clamping arm 607*d* that is adapted to fit tightly to the outside of the paint may be lined with a non-slip rubber strip (607*f*). The holder connects to the paintbrush at the narrowing part of the handle, just above the main paintbrush body, by means of a spring-loaded (607*j*) roller system (607*h*), this being the main saddle support (607*e*).

In an embodiment, the brush holder allows the bristles of the paintbrush to hang within the paint, keeping them moist and within the humidity of the paint can. With new, very-fast drying latex paints available today, this prevents the bristles from drying too quickly and hardening. In another embodiment, part 607*e* (i.e. the main saddle support) is on a hinge which allows part 607*e* to be flipped up into the vertical position while the painter is in the painting process, allowing complete access to the paint. When the brush is to be hung for a temporary period, part 607*e* is flipped into the horizontal position to receive the handle of the paintbrush and allow the paintbrush to hang with the bristles dipped into the paint.

Figure 26:
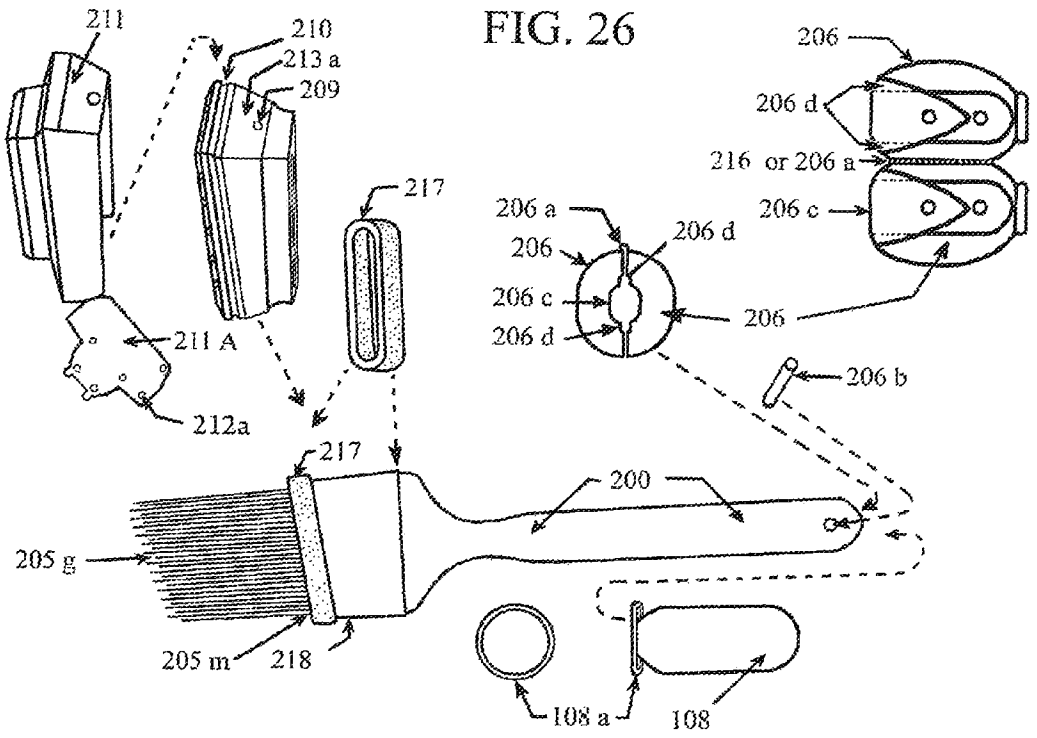
FIG. 26 illustrates the assembly of the light pack and other accessories for a standard style paintbrush according to one embodiment of the present invention.
Figure 27:
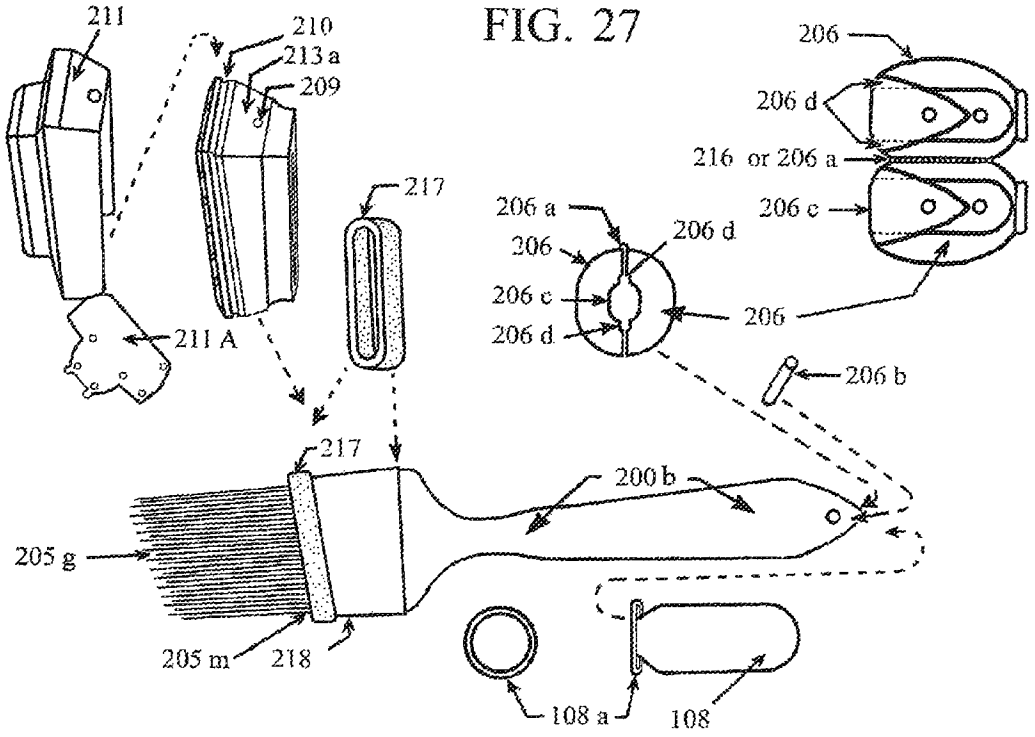
FIG. 27 illustrates the assembly of the light pack and other accessories for a standard style paintbrush according to another embodiment of the present invention.
Figure 28:
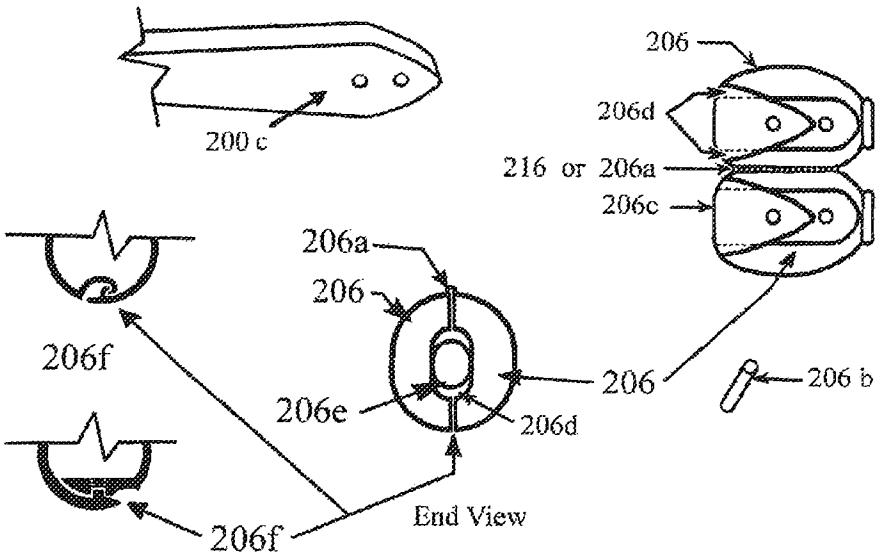
FIG. 28 illustrates the assembly of the enlarged handle grip for a standard style paintbrush according to one embodiment of the present invention.

In another aspect of the present invention an enlarged handle grip is designed for a standard paintbrush 206, style 1 and 2, with handle styles 200*a*, 200*b*, and 200*c*, as shown in FIGS. 26, 27, and 28, respectively. The enlarged handle grip may have the same outer shape as the enlarged battery area on the lighted paintbrush, so it may be hung in the same way. The enlarged handle grip may be removably attached to the end of the standard brush handle by inserting a pin 206*b* through the opening in the end of a standard paintbrush handle and into one of the plurality of matching support apertures in the enlarged handle grip (206).

Once the end of the paintbrush handle is fitting snugly in the cavity (206*c*, 206*d*, 206*e*, as shown in FIG. 26) against the one side of the enlarged handle grip, the other side may be snapped shut by means of a closing means which may be a hinge (206*a*), forming a ball-like structure (206) on the end of the handle as is shown in FIGS. 26, 27 and 28 in style 1 and style 2. There are various styles of closures possible for the enlarged handle grip including a metal locking open-and-closed type, or a plastic self-hinged style, with a small plastic latch. As the enlarged end of the LED or standard style paintbrush hangs from the main saddle support, the lower part of the brush may be supported by a u-shaped lower arm on the lower brush support and inside clamping arm 107A that is adapted to fit the inside of the can. The inside clamping arm is fitted with a biasing means which may be a spring, 107B and connected to an outside clamping arm 107D by a Pin. 107C. The pin may be made of metal or other strong material. The portion of the outside clamping arm 107D that is adapted to fit tightly to the outside of the paint may be lined with a non-slip rubber strip (not shown).

These two clamping arms may be squeezed together, causing a pivoting motion at the pin, 107C. This spreads the two clamping arms apart so they may be set over the top edge of the paint can and released, causing the biasing means between the two clamping arms to grip tightly to the top edge of the can. The non-slip rubber strip, on the paint can side of 107D, may prevent any sideways slipping motion while the horizontal portion of 107D may rest on top of the can to take the weight of the brush. Once the brush holder is clamped to the top of the can, the brush may be hung by the enlarged handle grip, and a height to hang the brush can be selected from the height adjustment means in the lower portion of the main saddle support 107E. A fastening means such as a screw may be inserted through the chosen hole into the horizontal threaded portion of the inside clamping arm 107A.

Figure 31:
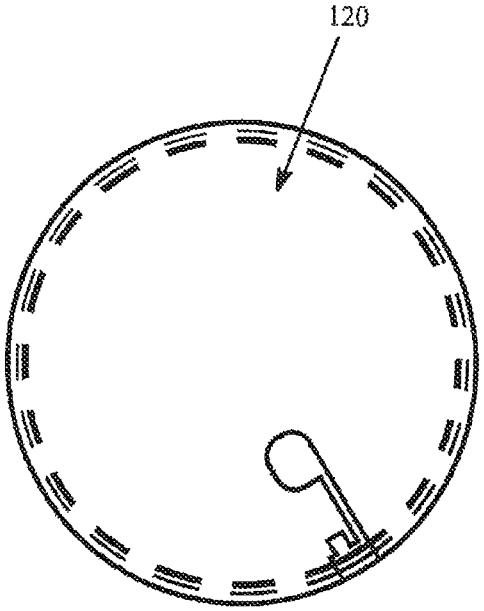
FIG. 31 illustrates a paint can lid according to one embodiment of the present invention.

Another aspect of the present invention is illustrated in FIG. 31, the paint can lid (120). The paint can lid may be used with the brush holder (107) that fits on any regular one gallon, (4-liter) paint can, as is designed to receive the lighted paintbrush, or any standard style paintbrush with the enlarged handle grip attachment removably installed on the handle. The brush holder may be a real asset because the typical method of laying the brush on the edge of the paint roller tray would end up in the lights getting covered in paint.

In alternative embodiment of the present invention, lighted paintbrush attachments may be adapted to engage a standard style paintbrush, and enabling the use of the new brush holder.

Figure 23:
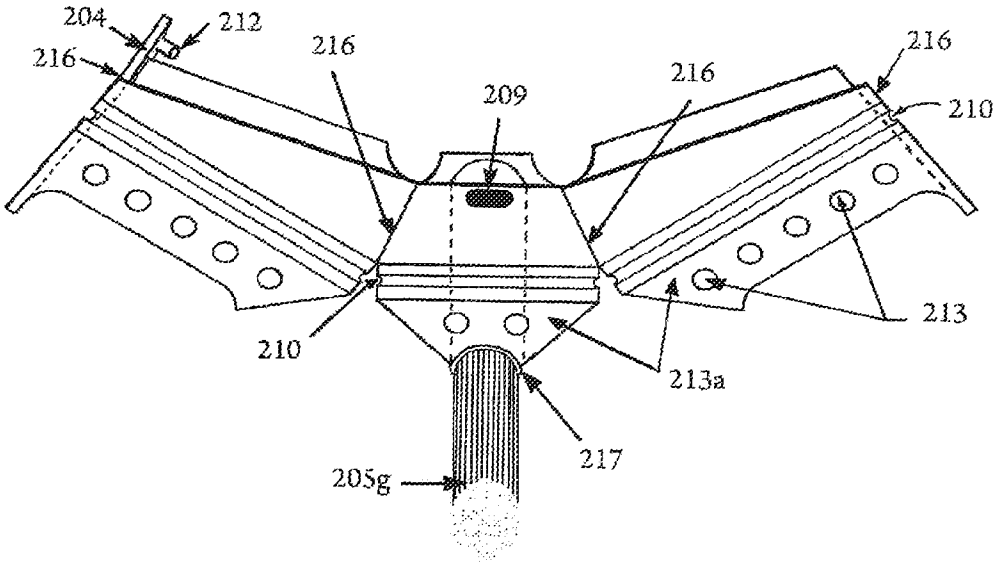
FIG. 23 illustrates the top front view of the light pack in open position for a standard style paintbrush.
Figure 24:
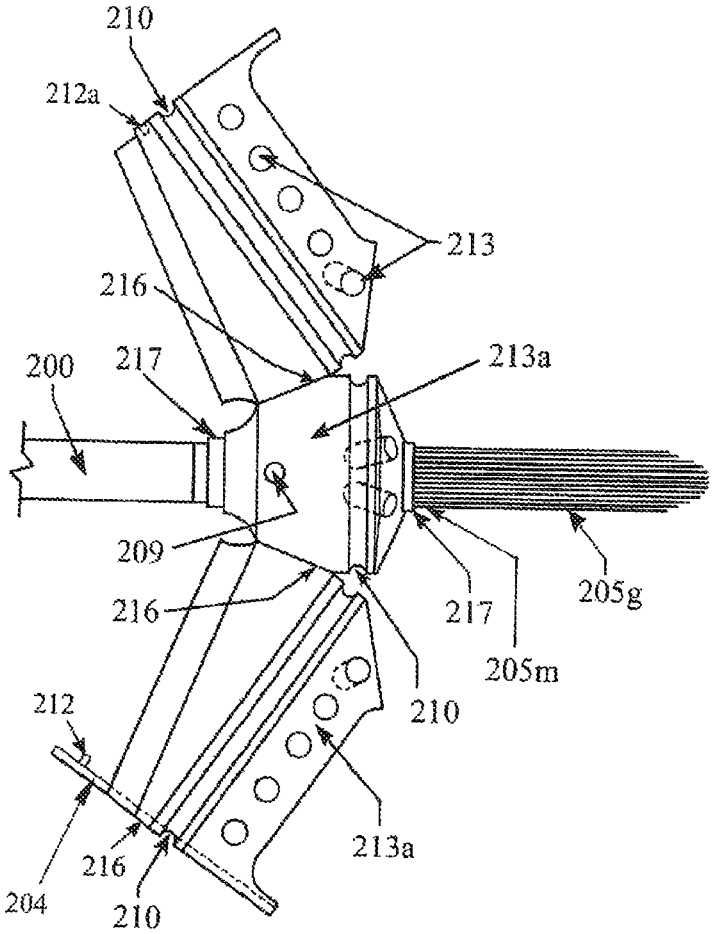
FIG. 24 illustrates the installation light pack on a standard style paintbrush.

In this embodiment a plurality of compressible rubber seals (217) may be placed around the standard brush ferrule (218). The front seal may partly wrap around the base of the bristles, and the front edge of the brush ferrule (see FIG. 26). The back seal may be placed over the brush ferrule and may line up with the back portion of the light pack (see FIGS. 19 to 24). The light pack may rest on top of the plurality of compressible rubber seals, then may close around the sides of the seals, with the final side being a closing means, such as a self-hinging latch (204), snapping shut with a plurality of pegs adapted to engage a receiving means (see FIG. 23).

Figure 30:
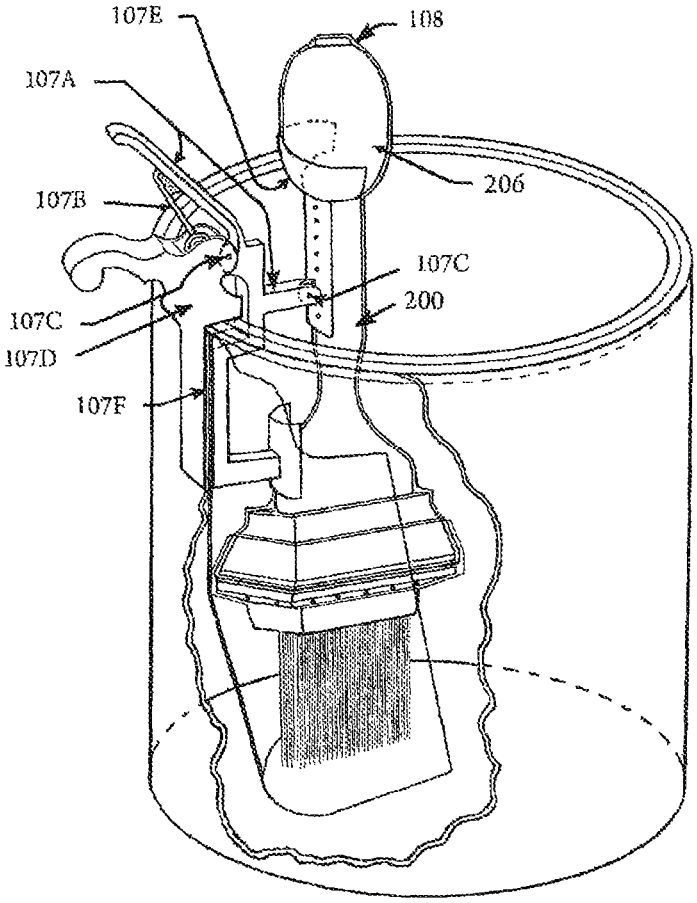
FIG. 30 illustrates the brush holder with adapted standard style paintbrush according to one aspect of the present invention.

To removably install the enlarged handle grip, a pin 206*b* may be inserted through the opening in a standard paintbrush handle and into one of the two matching support openings in the enlarged handle grip 206. Once the end of the paintbrush handle is fitting snugly against the one side of the enlarged handle grip, the other side may be snapped shut by a closing means such as a hinge, forming a ball-like structure (206) on the end of the handle as shown in FIGS. 26, 27 and 28, style 1 and style 2. Various styles of closing means are possible on the enlarged handle grip, including a metal locking open-and-closed type, or a plastic self-hinged style, with a small plastic latch (206*f* in FIG. 28). The enlarged handle grip end of the paintbrush may hang from the main saddle support of the brush holder as illustrated in FIG. 30.

Figure 29:
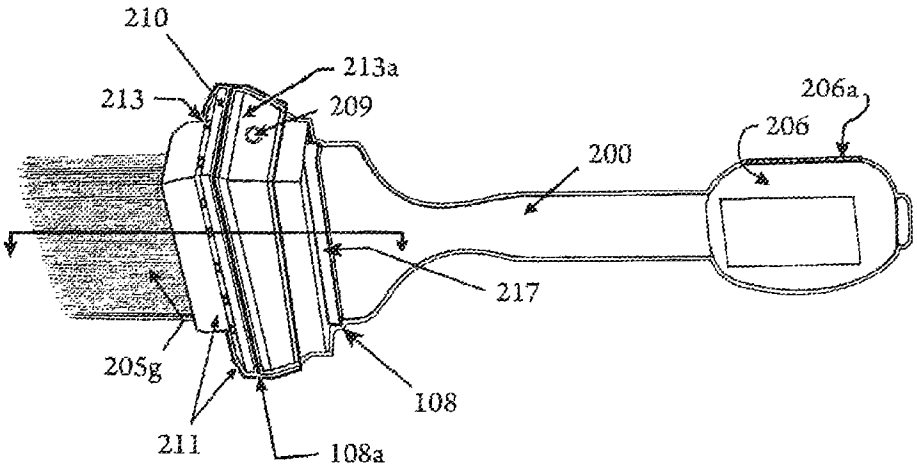
FIG. 29 illustrates the assembled standard style paintbrush according to one embodiment of the present invention.

After the light pack and the enlarged handle grip are removably installed, the latex covering 108 may be rolled on over the enlarged handle grip and the handle up to the groove in the light pack. The rim (108*a* FIG. 26) of the latex covering may rest in the groove 210 of the light pack 213*a*, shown in FIG. 29.

Figure 25:
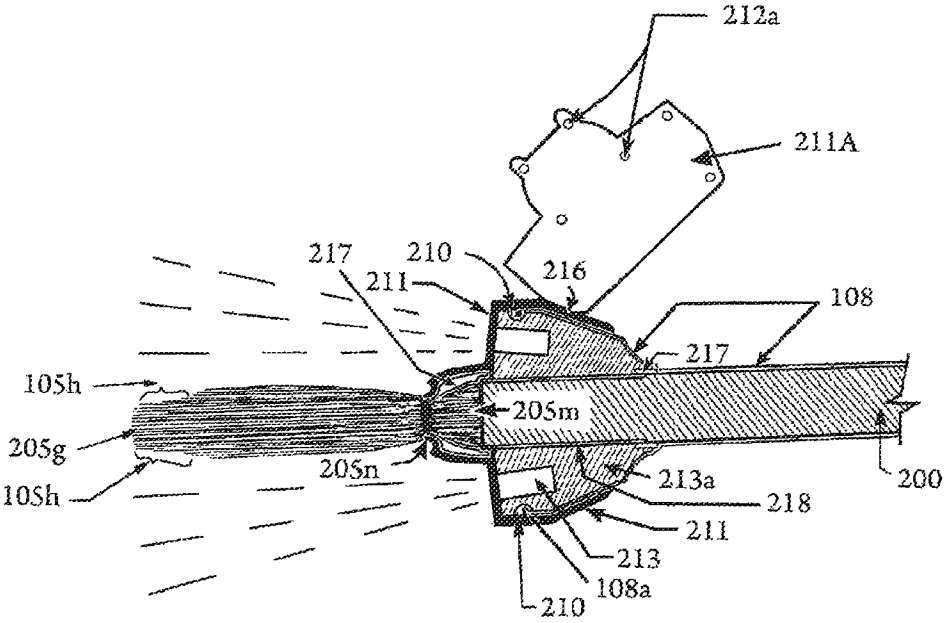
FIG. 25 illustrates the cross sectional view light pack in open position for a standard style paintbrush.

In another aspect of the present invention, the clear lens 211 may be removably attached to a standard style paintbrush. The clear lens may be installed by tightly sliding it down from the top (as in FIG. 26), over the light pack 213*a* and the latex covering 108 and then it may be snapped into the bottom side 211A of the lens cover. The plurality of receiving means 212*a* in the bottom side of the clear lens fit tightly around the pegs 212 in the bottom of the lens cover. When installed, the front compressible rubber seal and the front portion of the clear lens 211 may fit tightly to the bristles 205*g* to form a barrier to any paint or moisture from getting to the bristle base 205*m* as shown in FIG. 25.

Figure 32A:
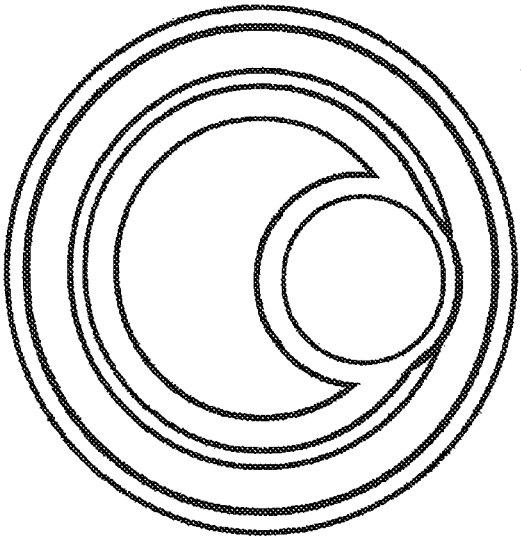
FIG. 32*a, b* and *c* illustrates a standard plastic paint can lid having a pour hole, a replacement cap and a pouring spout.
Figure 32B:
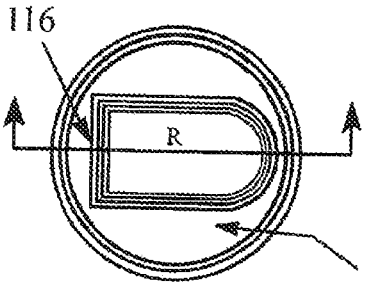
Figure 32C:
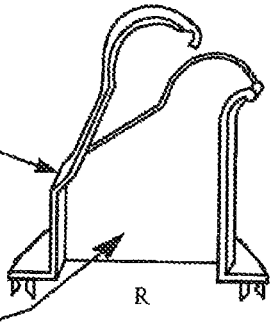

FIG. 32 illustrates the top of a standard plastic paint can that has a removable cap that exposes a pour hole. Typically when you pour from the plastic paint can, the structure of the pour hole is poor and paint is spilt. In the present invention, the replacement cap includes a moulded pouring spout having a tight fitting hinged lid. The replacement cap (121, FIG. 32) mates with the pour hole providing a tight fit on the standard plastic paint can top by means of a friction-fitted moulded locking system. The moulded pouring spout reduces spillage and the self hinge cap creates a secure seal between pours.

Figure 48:
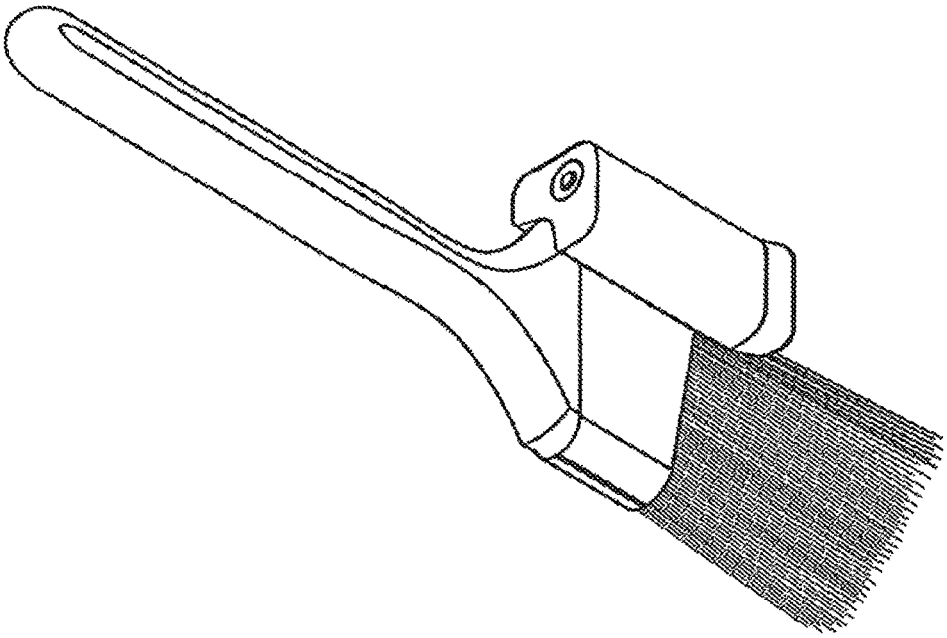
FIG. 48 is shows a first perspective view of a paintbrush with an illustrative light pack attached to the paintbrush ferrule in accordance with an embodiment.

Now referring to FIG. 48, shown is a first perspective view of a paintbrush with an illustrative light pack attached to the paintbrush ferrule in accordance with an embodiment. As shown, the light pack is mounted to one corner of the paintbrush ferrule such that a lip engages the shoulders of the paintbrush handle, keeping the light pack in position.

Figure 49:
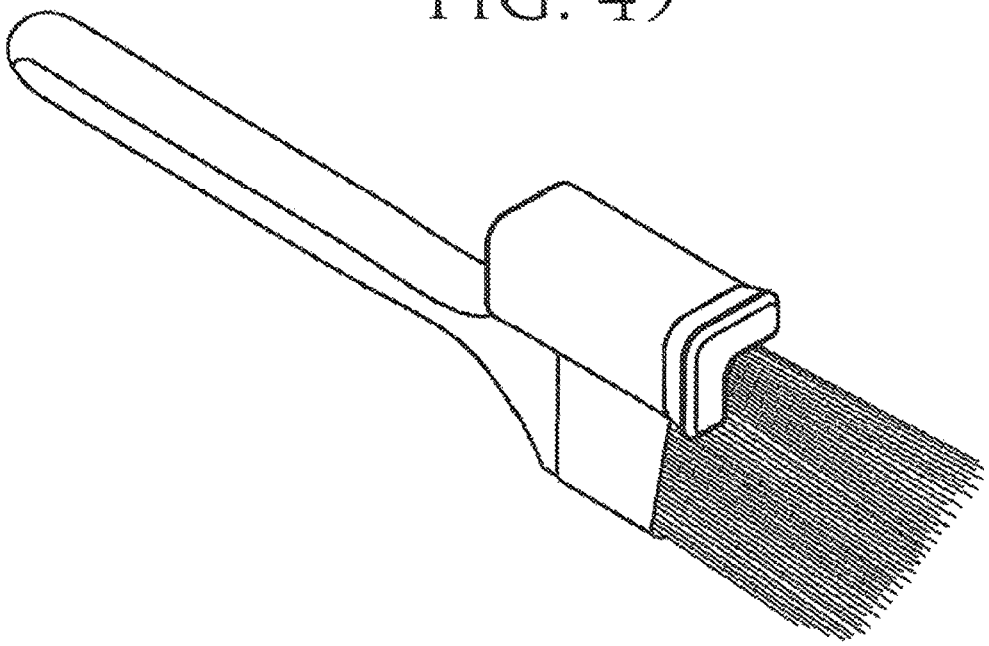
FIG. 49 shows a second perspective view of a paintbrush with an illustrative light pack attached to the paintbrush ferrule.

FIG. 49 shows a second perspective view of a paintbrush with an illustrative light pack attached to the paintbrush ferrule. As shown, the light pack includes a plurality of LEDs as seen through a lens cover near the front end of the light pack shell.

Figure 50:
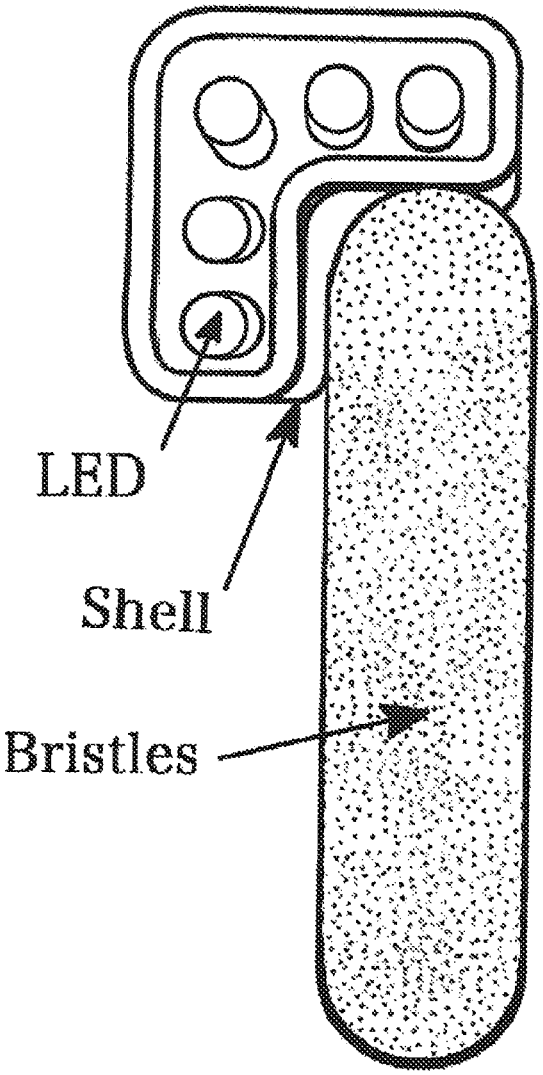
FIG. 50 shows a bottom view of a paintbrush with an illustrative light pack showing an arrangement of light emitting diodes (LEDs) at one corner of the brush.
Figure 51:
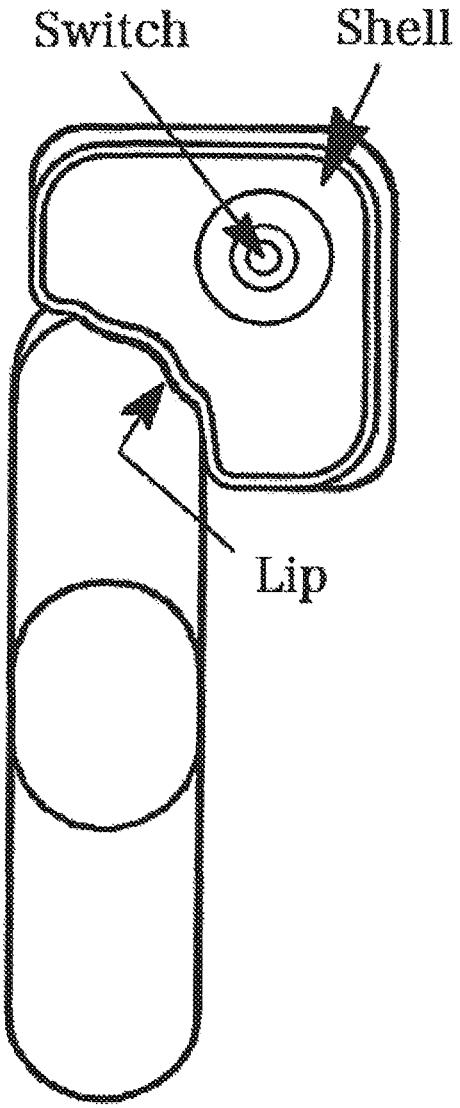
FIG. 51 shows a top view of the paintbrush of FIG. 50 with the light pack at one corner of the brush.

FIG. 50 shows a bottom view of the paintbrush with an illustrative light pack showing an arrangement of LEDs at one corner of the brush. FIG. 51 shows a top view of the paintbrush of FIG. 50 with the light pack attached at one corner of the brush.

In a preferred embodiment, the positioning of the light pack on the paintbrush is predetermined such that the LEDs are pointed towards a suitable position as earlier described.

In another embodiment, the light pack comprises a waterproof or water resistant shell which may be formed, for example, from a solvent-resistant type of plastic. The waterproof or water resistant shell provides protection for the LEDs, switch lighting circuitry, magnets and batteries from the paint during use, and also allows the light pack to be washed under tap water to remove any paint residue or dirt In an illustrative embodiment, generally, all corners of the light pack are rounded on the shell, lens cover, and on/off switch, to avoid any corners or other tight areas that can trap paint and cause paint build-up. Also, all designs and materials used for the light pack allow for an easy rinse under tap water with no sharp areas to catch paint.

In an embodiment, the only exception to the generally rounded contours of the light pack is the inside portion of the lip which is found at the back of the light pack on the main shell, just below the switch. This lip holds the light pack from slipping/moving ahead when pressure is put to the switch by the painter's pointer finger to turn the LED's on/off or change light intensities. This lip extends down from the light pack to catch the upper back corner of the shoulder or widened portion of the brush just adjacent the ferrule. This lip design allows for the light pack to be installed quickly and consistently each time, on an exact location of the ferrule of the paintbrush. This allows for the angled LED's to light up the exact location that the light is required, since the LED's are always the same distance away from the end of the bristles/painting project when placed on the same brush. That is, each time the light pack is reinstalled on a paintbrush in the same position by resting the light pack on the top of the ferrule of the paintbrush and then slipping it forward until the lip meets the rear widened portion of the brush handle. Thus, the LED'S are always consistently the same distance away from the end of the bristle/painting project" even in a quick installation, due to the lip meeting the paintbrush handle at the same place every single time the light pack is installed.

Figure 55:
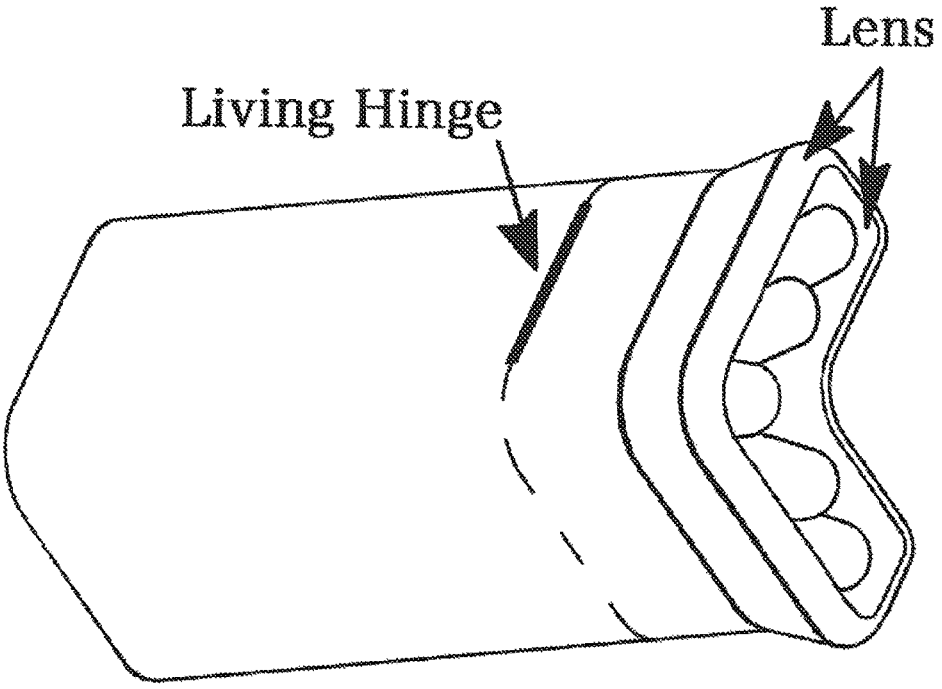
FIG. 55 shows a fifth perspective view of the light pack of FIG. 52.

In an embodiment, when the light pack of FIG. 55 is installed, the lip of the light pack is configured as a stopping mechanism when the light pack is placed on the brush and slid forward. Similarly, in the light pack shown in FIG. 60, there is a) an initial ridge of the lip shown just behind the magnets that causes resistance on almost all of the paintbrushes and b) the shape of the lip(s) that hug the back portion of the paintbrush handle, and c) the prong that acts as a last resort to stop the sliding forward of the light pack by poking/biting into the paintbrush handle. This prong allows the light pack to be adapted to different types of brushes.

Other types of stopping mechanisms could be provided on a light pack. It should be noted that a pointed portion of the lips "D", shown in FIGS. 60 & 61, helps the light pack hug a back portion of the paintbrush handle, whether the light pack is in on a left corner or a right corner of the paintbrush. The lips help resist sideways rotation of the light pack around the brush ferrule when pressure is put on the switch to turn it off or on or change light intensities.

In an embodiment, the inside portion of the lip at the rear portion of the light pack may be made with a sharper edge, such that the light pack does not get in the way of a comfortable grip, and such that the light pack is more difficult to accidentally or unintentionally knock off the light pack during use. Furthermore, the location and positioning of the lip allows the light pack to be fixed into position consistently each time, on the same paintbrush or same type of paintbrush, such that the light pack is directing light to the appropriate position each time.

Now referring to FIGS. 51 to 55, shown are different perspective views of the light pack in accordance with an embodiment. As shown, in a preferred embodiment, magnets are used to primarily to hold the light pack in place on a paintbrush ferrule. The magnets may be two or more rare earth magnets located within the light pack shell, and the light pack shell in the battery area are thinned in order to allow for better contact of the magnets to the paintbrush ferrule. This provides a cleaner look with no exposed magnets. However, in an alternative embodiment, the magnets could be provided directly on the light pack shell such that the magnets can make direct contact with the paintbrush ferrule and provide a stronger attachment. For example, the magnets may be exposed and fastened to the exterior of the Light pack's shell by being recessed into a tightly designed slot or recess formed in the shell, and held in place by glue or other fastening means.

Figure 52:
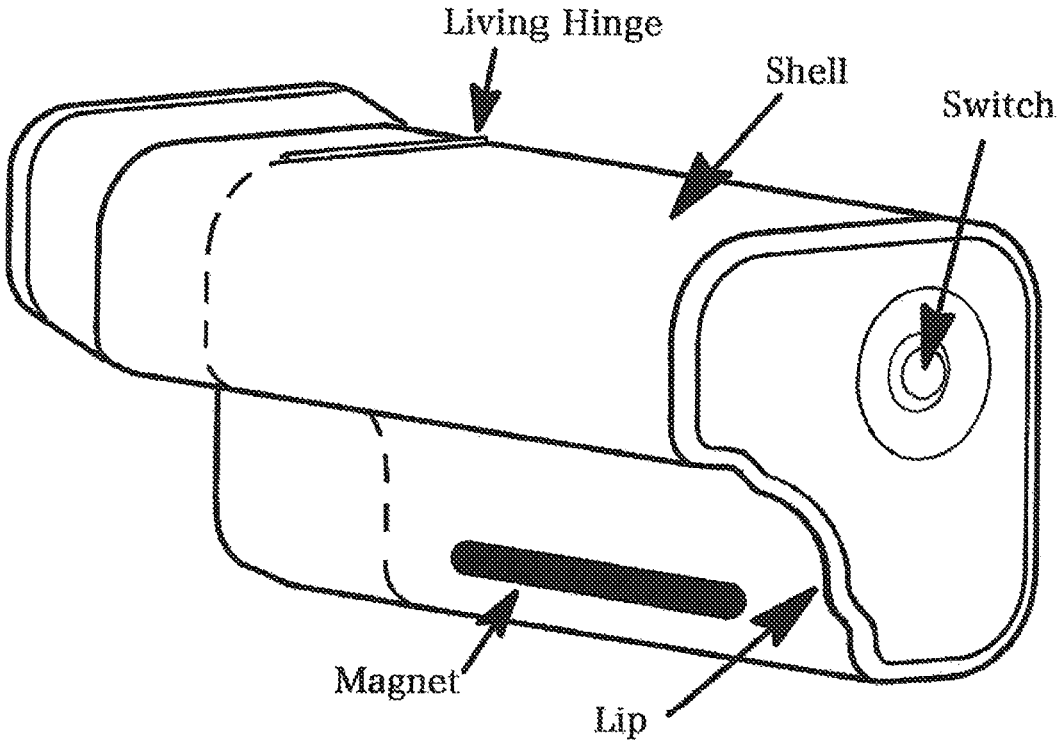
FIG. 52 shows a perspective view of a light pack in accordance with an embodiment.
Figure 53:
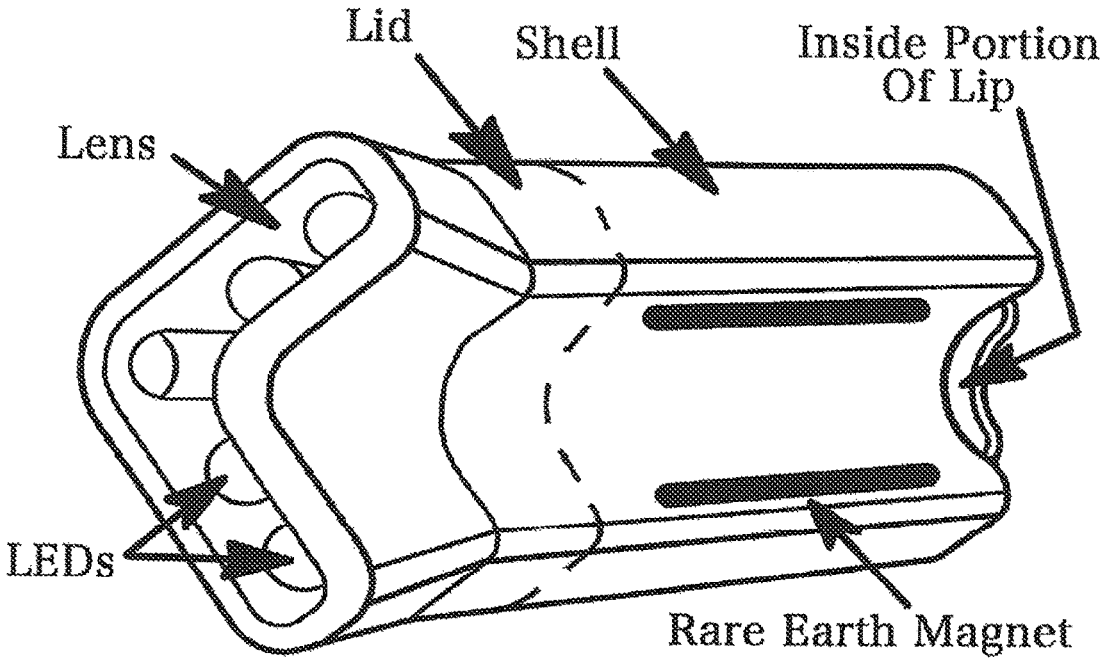
FIG. 53 shows a third perspective view of the light pack of FIG. 52.
Figure 54:
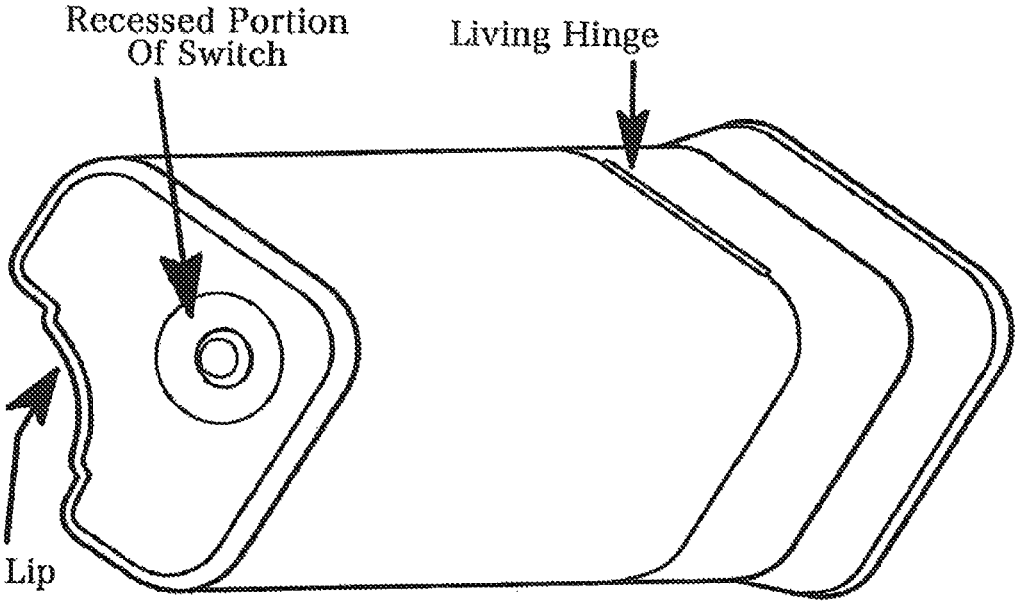
FIG. 54 shows a fourth perspective view of the light pack of FIG. 52.

In various embodiments, in the design shown in FIG. 52, the magnets may be internal or external to the shell.

In an embodiment, the light pack shell is preferably a durable plastic material, pliable enough to allow a sufficiently long length of life to a hinge portion connecting the lid.

In another embodiment, the light pack shell is also continuous and thinned over a switch area to ensure water tightness, and cause less resistance when switching the LED's on and off. In another embodiment, the area located around the switch is also recessed or otherwise physically distinguished in order to help the painter's finger comfortably and easily find the switch by feel, without having to search for it visually.

Figure 56:
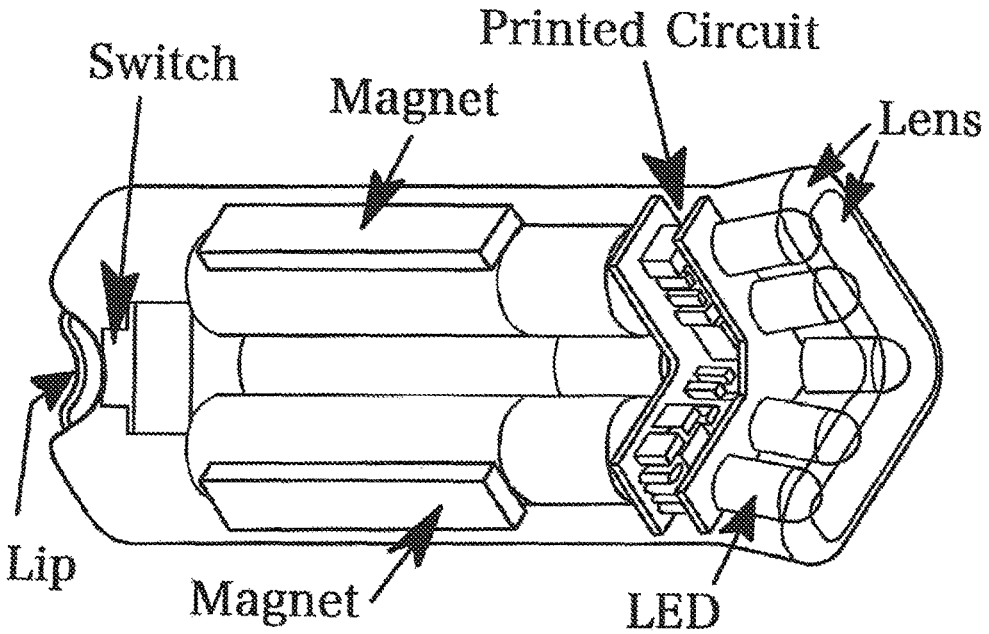
FIG. 56 shows a transparent view of the light pack with an arrangement of batteries shown within the body of the light pack.
Figure 57:
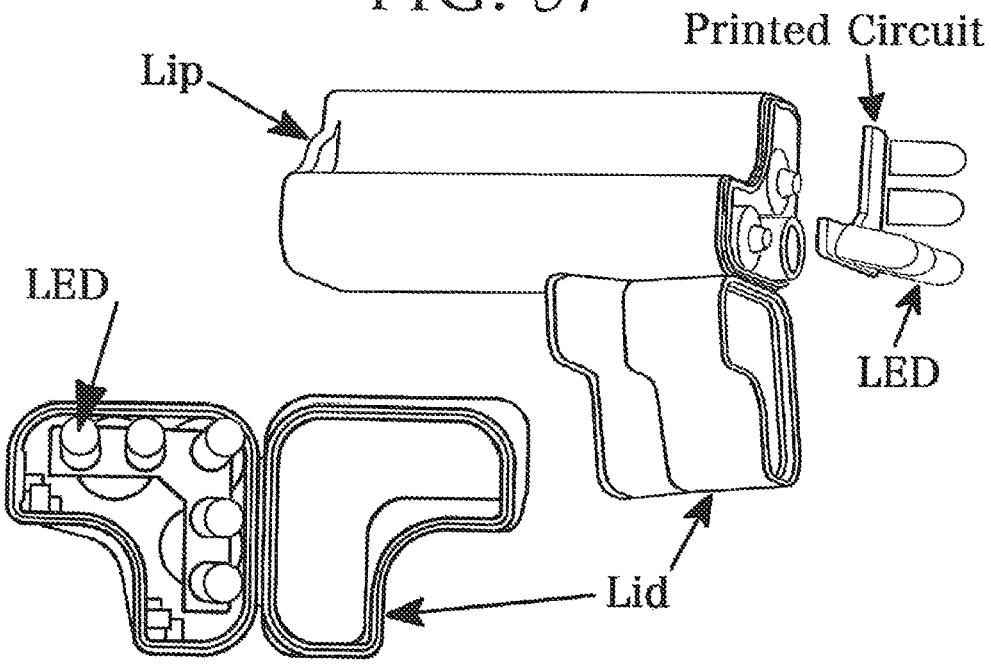
FIG. 57 shows close-up view of a light pack in accordance with an embodiment in which a lid opens to provide access to a battery compartment and a plurality of LED circuits.

Now referring to FIG. 56, which shows a transparent view of the light pack shell with an arrangement of batteries, LEDs, a switch and lighting circuitry shown within the light pack shell. FIG. 57 shows a close-up view of the light pack shell in accordance with an embodiment, in which a lid opens to provide access to a battery compartment and a plurality of LEDs and lighting circuits. In an embodiment, the batteries, LEDs and lighting circuits are all replaceable upon exhaustion or failure via the opening lid.

In an embodiment, as best shown in FIGS. 53, 55, 56, 57 & 60, a one-piece lens may covers all five LED's. The one-piece lens has rounded edges, and is easy-to-clean since there are no crevices for paint to collect. The lens may be formed, for example, from a solvent-resistant type of plastic, such as Lexan. The lens will normally be attached to the lid to create a water tight seal. This may be achieved by means of a gasket and screws, for example, that are installed from the underside of the lid reaching through it into the lens. The geometry of the inside lower portion of lens may be moulded with holes that will guide and bend the leads of the Led's when the parts are assembled together to ensure the LED's are pointing exactly the right direction and held firmly in position. It is also contemplated that a one piece lens cover may be directly fused with or integrally formed as part of the lid portion of the shell to produce a water-tight seal.

Figure 58:
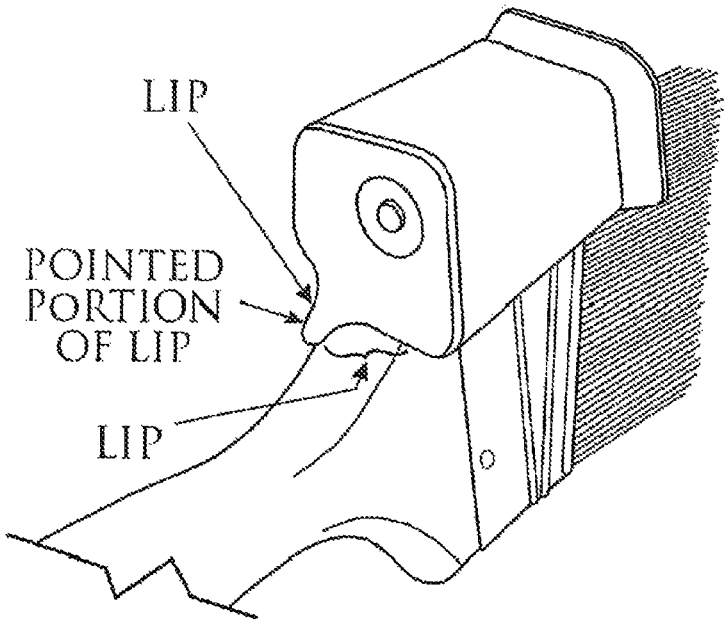
FIG. 58 shows a perspective view of another illustrative light pack having lips which conform to the base of a handle of a paintbrush in accordance with an embodiment.
Figure 59:
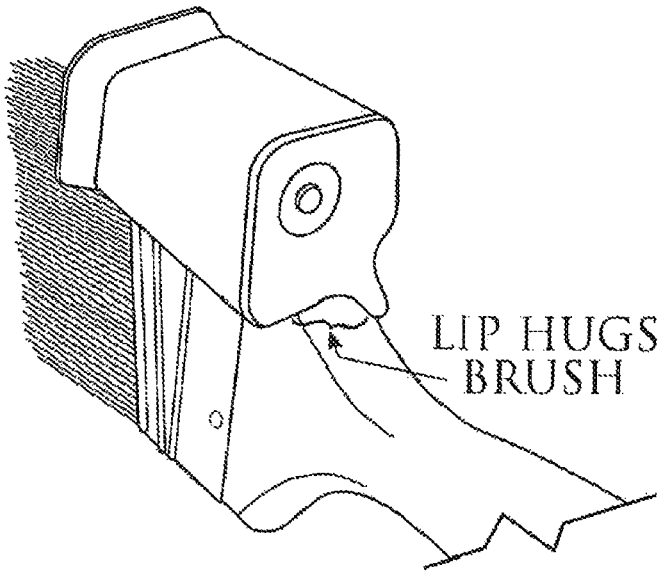
FIG. 59 shows another perspective view of the illustrative light pack of FIG. 58.
Figure 60:
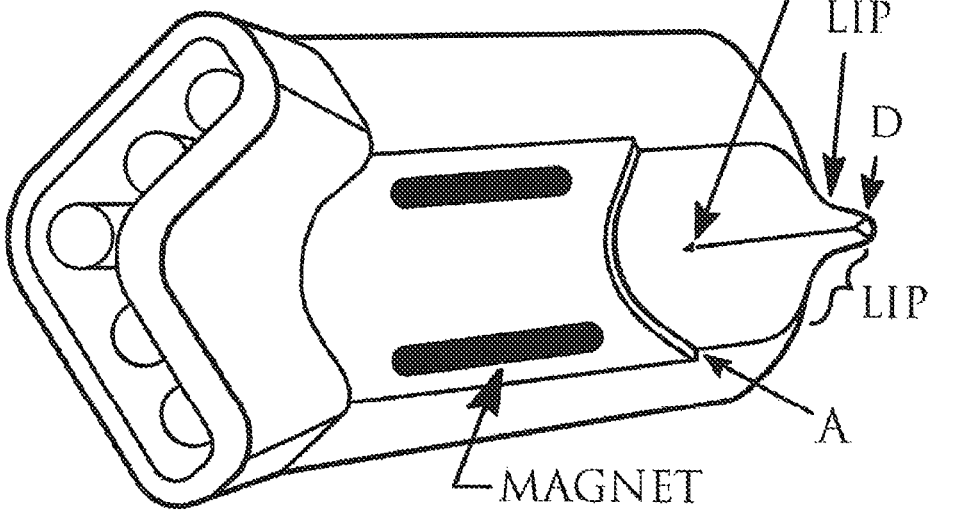
FIG. 60 shows a detailed close up view of a light pack having an arrangement of magnets, a lip and a prong for fastening the light pack to a corner of a paintbrush ferrule.
Figure 61:
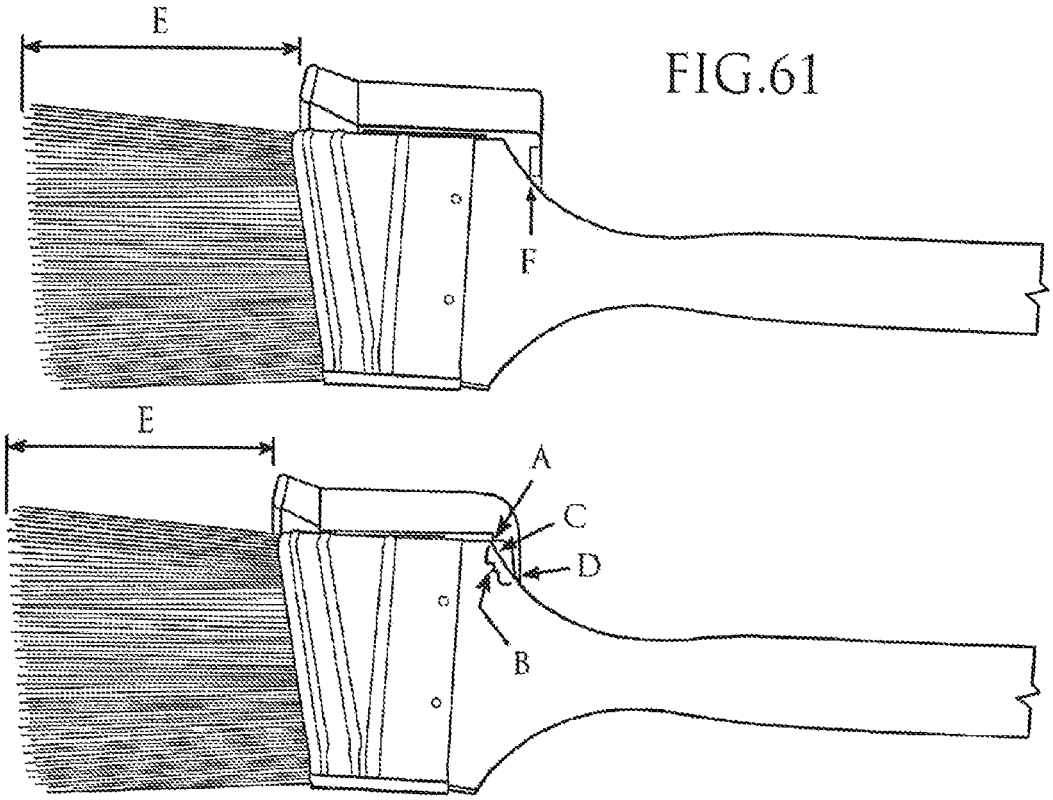
FIG. 61 shows illustrative examples of light packs having different styles of lip portions in accordance with an embodiment attached to two similar sizes of brushes.
Figure 62A:
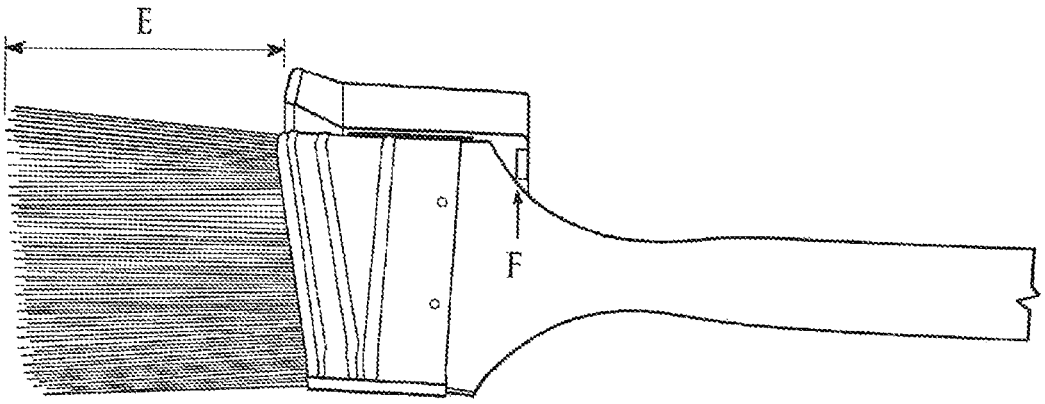
FIGS. 62A-62D show various embodiments of the light pack in which "F" signifies where the lip meets the rear widened portion of the brush handle, and "E" refers to the respective distances from the front of the light pack to the tip of the bristles for each type of brush.
Figure 62B:
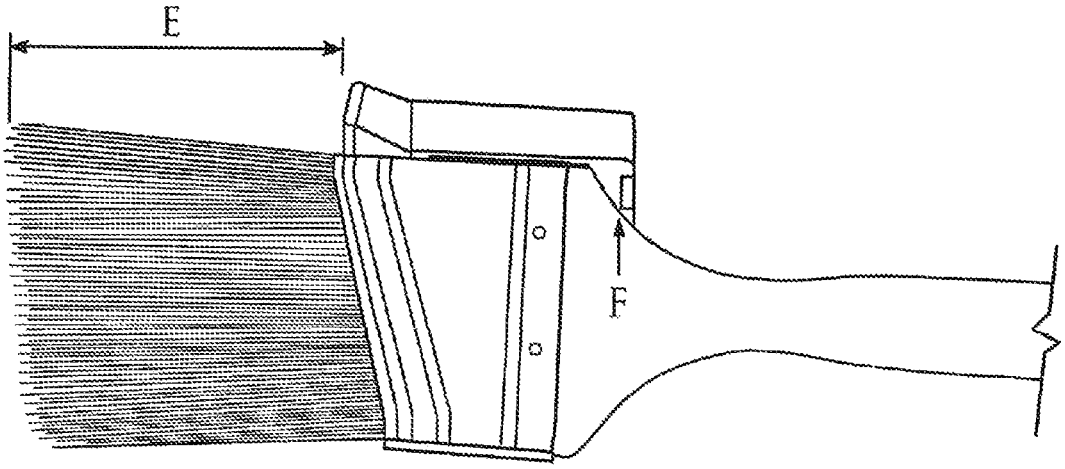
Figure 62C:
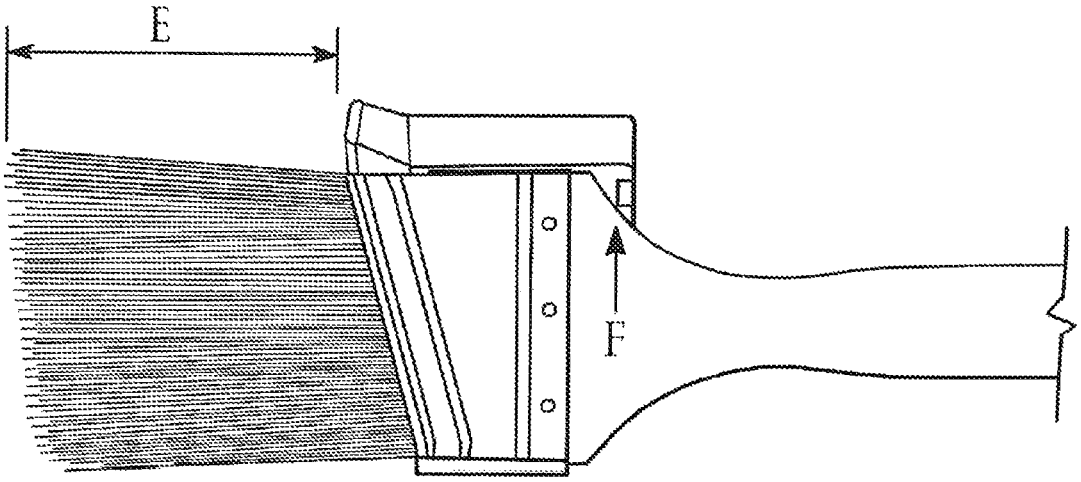
Figure 62D:
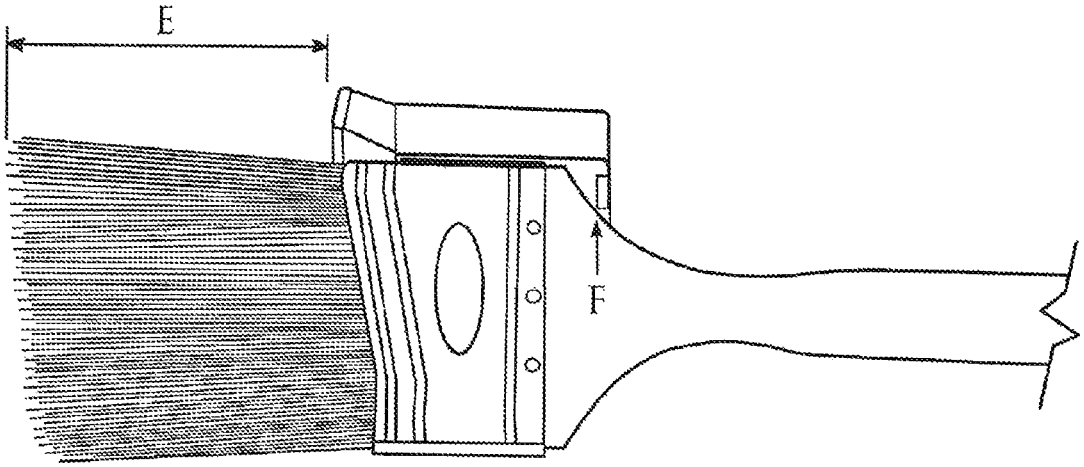

Now referring to FIGS. 58, 59 and 60, shown are close up, perspective views of a possible shape of a light module shell, attached to a paintbrush. In an embodiment, as shown in FIG. 60, the light pack shown is removably fastened to the paintbrush ferrule by two rectangular-shaped rare earth magnets that are internally moulded inside the shell and/or possibly glued into a slotted track on the exterior of the outer shell. When the light pack is installed on a corner of the paintbrush ferrule, one magnet contacts the one side of the ferrule, and the other magnet contacts another side of the ferrule, holding the light pack firmly in place with the lip portion of the light pack supporting the light pack against the paintbrush. The light pack is easily removed and rotated onto another corner of the brush quickly and/or taken off and put away when it is not required.

Still referring to FIG. 60, the lip and the prong also help to attach the light pack to the paintbrush. In an embodiment, the light pack is shaped to hug a widened portion of the paintbrush just adjacent the ferrule to resist any sliding movement when the switch is pressed to turn the lights on/off or set at a different intensity. As shown in FIG. 60, in an embodiment, the inside of the lip may include one or more prongs or spikes which bite or poke into the widened portion of the paintbrush just adjacent the ferrule to mechanically prevent the light pack from moving forward or sideways when the switch is pressed. It is also possible that other devices suitable for mechanically securing or at least minimizing movement of the light pack relative to the paintbrush may also be used.

Now referring to FIGS. 62A-62D, shown are various embodiments of the light pack in which "F" signifies where the LIP meets the rear widened portion of the brush handle, and "E" refers to the distance from the front of the Light Pack to the tip of the bristles.

In an illustrative embodiment, the light pack is adapted to fit a ⅝" thick angled sash brush style of handle which is commonly used by a large number of paintbrush manufacturers. The general consistency of paintbrush handle shapes and styles between different paintbrush companies is best shown in the images 62A to 62D, for example, showing an illustrative light pack attached thereto. Note the front of the light pack and how many paintbrush ferrules match up very closely with the brush ferrule edge. The bristle lengths on these various brushes are also reasonably close, within a fraction of an inch. With these bristles being so close in length, and the fact that the painter is applying pressure on the brush at different rates, the light pack will thus be very close to the same distance away from the object.

Figure 63A:
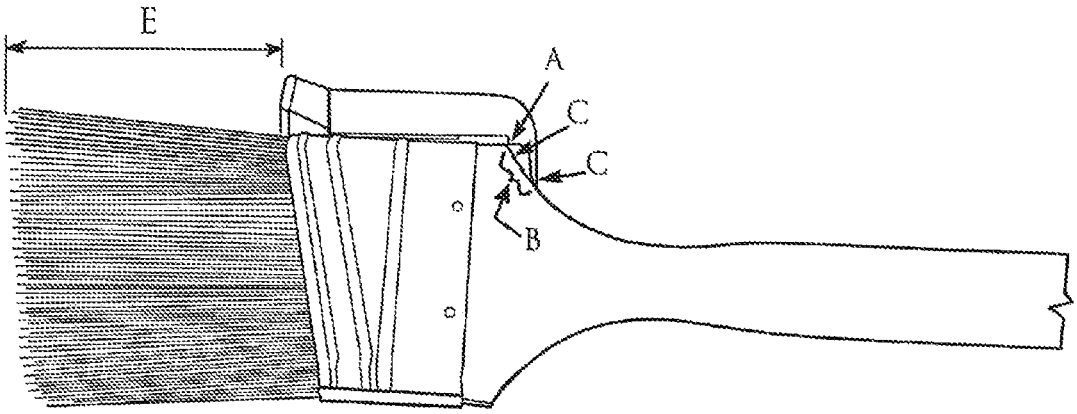
FIGS. 63A-63C show various embodiments in which the light pack includes a prong as shown at "C".
Figure 63B:
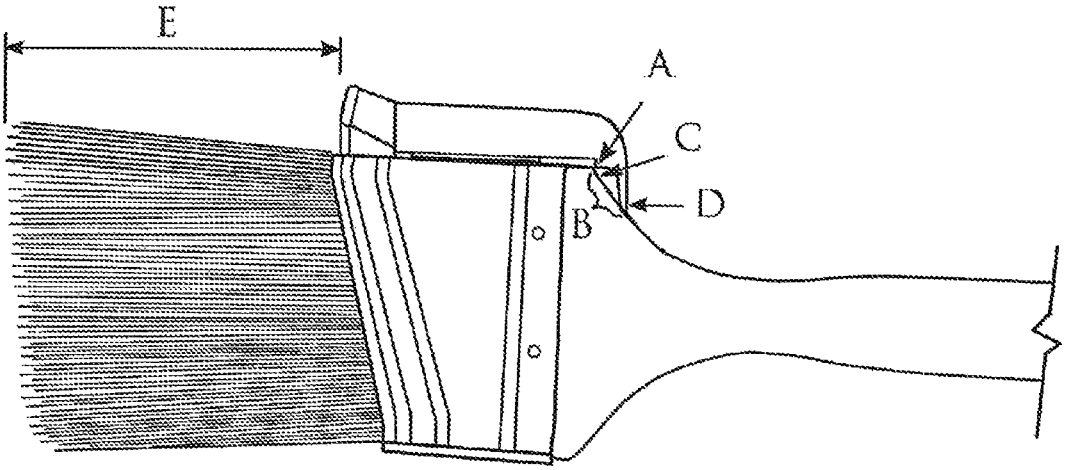
Figure 63C:
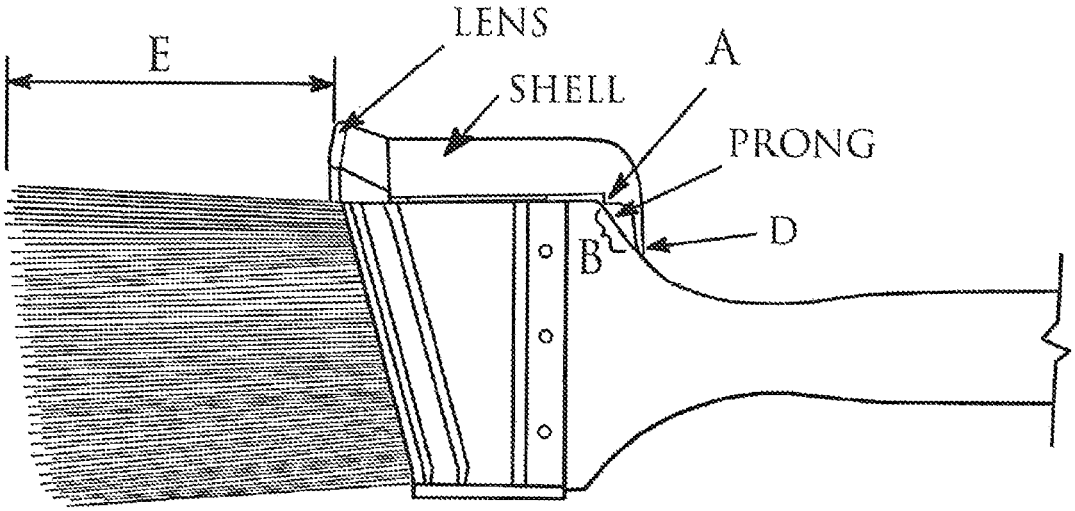

FIGS. 63A-63C show various embodiments of the light pack in which "A" refers to an initial ridge of the Lip shown just behind the magnets, "B" is a side view of the Lip of the Light Pack, "C" shows the location of the prong, and "D" is the pointed portion of the lips.

While illustrative embodiments of the invention have been described above, it will be appreciate that various changes and modifications may be made without departing from the scope of the present invention.

The invention claimed is:

1. A light pack for a paintbrush, the paintbrush comprising a handle having a gripping end and a bristle end with a plurality of bristles, a ferrule having a plurality of sides comprising first, second, third and fourth sides extending continuously around the bristle end and having a plurality of outer corners, each outer corner formed by an intersection between each of the first and second, second and third, third and fourth, and fourth and first sides of the ferrule, the outer corners running parallel with the plurality of bristles having an edge to contact an object being painted, wherein the light pack comprises a waterproof outer shell, and is adapted to be removably securable to at least one of the plurality of outer corners, the waterproof outer shell of the light pack shaped to engage at least two adjacent sides comprising the first and second, the second and third, the third and fourth, or the fourth and first sides of the ferrule when in position around at least one of the plurality of outer corners of the ferrule such that one or more lights in the light pack are aimed to emit light simultaneously around the corner formed by the at least two adjacent sides of the ferrule at an angle toward the edge when the bristles are bent when an object is painted.

2. The light pack of claim 1, wherein the light pack further includes a lip, the lip of the light pack adapted to engage a shoulder of the paintbrush handle such that the light pack is held in position relative to the handle.

3. The light pack of claim 1, characterized in that the light pack is removably securable to the ferrule of the paintbrush by a magnet.

4. The light pack of claim 3, characterized in that the magnet is enclosed within the light pack.

5. The light pack of claim 4, characterized in that the magnet is external to the light pack.

6. The light pack of claim 1, characterized in that the one or more lights are LEDs.

7. The light pack of claim 1, characterized in that the light pack includes a battery.

8. The light pack of claim 1, characterized in that the light pack substantially encloses one or more batteries within the light pack.

9. The light pack of claim 1, characterized in that the light pack is turned on and off by means of one or more switches.

10. The light pack of claim 1, wherein the waterproof outer shell is L-shaped and adapted to engage two adjacent sides of the ferrule.

11. A lighted paintbrush apparatus comprising:

(a) a handle having a gripping end and a bristle end, the bristle end having a ferrule with a plurality of sides comprising first, second, third and fourth sides extending around a bristle end with a plurality of bristles, and having a plurality of outer corners running parallel with the plurality of bristles, each outer corner formed by an intersection of two between each of the first and second, the second and third, the third and fourth, and the fourth and first sides of the ferrule;

and (b) a light pack comprising a waterproof outer shell, the light pack adapted to be removably securable to at least one of the plurality of corners of the ferrule, the waterproof outer shell of the light pack shaped to engage at least two adjacent sides comprising the first and second, the second and third, the third and fourth, or the fourth and first sides of the ferrule such that one or more lights in the light pack are aimed to emit light simultaneously around the corner formed by the at least two adjacent sides of the ferrule at an angle toward the edge when the bristles are bent when an object is painted.

12. The lighted paintbrush of claim 11, characterized in that the bristle apparatus comprises resilient arms for securing the bristle apparatus in the opening.

13. The lighted paintbrush of claim 11, wherein the light pack further includes a lip, the lip of the light pack adapted to engage a shoulder of the paintbrush handle such that the light pack is held in position relative to the handle.

14. The lighted paintbrush of claim 11, characterized in that the light pack is removably securable to the ferrule of the paintbrush by a magnet.

15. The lighted paintbrush of claim 14, characterized in that the magnet is enclosed within the light pack.

16. The lighted paintbrush of claim 14, characterized in that the magnet is external to the light pack.

17. The lighted paintbrush of claim 11, wherein the waterproof outer shell is L-shaped and adapted to engage two adjacent sides of the ferrule.

* * * * *